US006022100A

United States Patent [19]

Takenouchi et al.

[11] Patent Number: 6,022,100

[45] **Date of Patent: *Feb. 8, 2000**

[54] LIQUID JET RECORDING HEAD HAVING INTERNAL STRUCTURE FOR CONTROLLING DROPLET EJECTION AND INK FLOW

[75] Inventors: Masanori Takenouchi, Yokohama; Shinichi Hirasawa, Sagamihara; Kunihiko Maeoka, Kawasaki; Hiroto Takahashi, Yokohama; Toshiharu Inui, Yokohama; Kazuhiro Nakajima, Yokohama; Hidemi Kubota, Komae, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/558,416

[22] Filed: Nov. 16, 1995

Related U.S. Application Data

[63] Continuation of application No. 08/215,400, Mar. 21, 1994, abandoned, which is a continuation of application No. 07/855,084, Mar. 20, 1992, abandoned.

[30] Foreign Application Priority Data

| | | | |
|---|---|---|---|
| Mar. 20, 1991 | [JP] | Japan | 3-057456 |
| Mar. 20, 1991 | [JP] | Japan | 3-057458 |
| Mar. 20, 1991 | [JP] | Japan | 3-057459 |

[51] Int. Cl.[7] ..... B41J 2/05

[52] U.S. Cl. ..... 347/65; 347/94

[58] Field of Search ..... 347/65, 63, 94

[56] References Cited

U.S. PATENT DOCUMENTS

| | | | |
|---|---|---|---|
| 4,296,421 | 10/1981 | Hara | 347/56 |
| 4,313,124 | 1/1982 | Hara . | |
| 4,330,787 | 5/1982 | Sato et al. | 347/63 |
| 4,345,262 | 8/1982 | Shirato et al. . | |
| 4,459,600 | 7/1984 | Sato et al. | 347/56 |
| 4,463,359 | 7/1984 | Ayata et al. . | |
| 4,502,060 | 2/1985 | Rankin et al. | 347/65 |
| 4,558,333 | 12/1985 | Sugitani et al. . | |
| 4,723,129 | 2/1988 | Endo et al. | 347/56 |
| 4,740,796 | 4/1988 | Endo et al. | 347/56 |
| 4,894,667 | 1/1990 | Moriyama | 346/140 R |
| 5,023,630 | 6/1991 | Moriyama | 346/140 R |
| 5,148,192 | 9/1992 | Izumida | 347/65 |

FOREIGN PATENT DOCUMENTS

| | | | |
|---|---|---|---|
| 0140611 | 5/1985 | European Pat. Off. | B41J 3/04 |
| 0313341 | 4/1989 | European Pat. Off. | B41J 3/04 |
| 54-056847 | 5/1979 | Japan | B41M 5/26 |
| 55-059975 | 5/1980 | Japan | B41J 3/04 |
| 55-059976 | 5/1980 | Japan | B41J 3/04 |
| 55-059977 | 5/1980 | Japan | B41J 3/04 |
| 55-100169 | 7/1980 | Japan | B41J 3/04 |
| 59-123670 | 7/1984 | Japan | B41J 3/04 |
| 59-138460 | 8/1984 | Japan | B41J 3/04 |
| 59-138461 | 8/1984 | Japan | B41J 3/04 |
| 60-071260 | 4/1985 | Japan | B41J 3/04 |
| 60-204352 | 10/1985 | Japan | B41J 3/04 |
| 61-040160 | 2/1986 | Japan | B41J 3/04 |
| 62-179949 | 8/1987 | Japan | B41J 3/04 |
| 2-4510 | 1/1990 | Japan | B41J 2/045 |

OTHER PUBLICATIONS

Drake, D.J., "Direction Sideshooter Bubble Jet Printhead", Xerox Disclosure Journal, vol. 14, No. 3, May/Jun. 1989.

Hawkins et al; Sideshooter with High Frequency Response; Xerox Disclosure Journal, V14, N3, May/Jun. 1989, pp. 105–107.

*Primary Examiner*—Joseph Hartary

*Attorney, Agent, or Firm*—Fitzpatrick, Cella, Harper & Scinto

[57] ABSTRACT

A recording head includes a liquid ejecting outlet, a liquid passage communicating with the ejection outlet, and a heat generating resistor for supplying heat to the liquid in a heat acting portion in the liquid to create a bubble in the liquid passage to eject the liquid through the ejection outlet. A cross-sectional area of the liquid passage increases from the heat acting zone toward the ejection outlet, and this improves performance while also improving head durability.

21 Claims, 18 Drawing Sheets

LIQUID JET RECORDING HEAD HAVING INTERNAL STRUCTURE FOR CONTROLLING DROPLET EJECTION AND INK FLOW

This application is a continuation of application Ser. No. 08/215,400 filed Mar. 21, 1994, now abandoned, which was a continuation of application Ser. No. 07/855,084, filed Mar. 20, 1992, now abandoned.

FIELD OF THE INVENTION AND RELATED ART

The present invention relates to a liquid jet recording technique, more particularly to a liquid jet recording heat and a recording device having the same usable with office equipment such as printer, copying machine or facsimile machine. More particularly, it relates to a liquid jet recording head having an improved liquid passage (nozzle) from the standpoint of high quality and high speed printing.

Ink jet recorders in which the ink is ejected, are known as a non-impact type recording device. As for the means for ejecting the ink, it is known to use a piezoelectric element for mechanically deforming the ink to reduce the volume of the liquid passage to eject the ink, and a heat generating resistor which is effective to apply heat to the ink in a liquid passage to produce an instantaneous state change thereof adjacent the heat generating portion, so that the ejection pressure is imparted to the ink.

Japanese Laid-Open Patent Application Nos. 59975/1980, 59976/1980 and 59977/1980 and U.S. Pat. No. 4,330,787 suggest ways to improve the ejection efficiency, the ejection response property, the ejection stability, the long period continuing printing and high speed recording or the like. However, the recent demand for the high speed and high resolution with further stability, has required a further improvement. More particularly, further improvement is desired in the ejection efficiency, a higher speed liquid ejection and higher stability.

Among those tasks, the high quality and high resolution problems are concerned with microdroplets resulting in shot of microdroplets at deviated positions. Referring to FIG. 30, there is shown a top sectional view of a heat generating element 1 positioned in a recording heat. FIG. 31 presents side views corresponding to FIG. 30, but FIG. 31 (1) shows a state before a state when FIG. 30 (1) occurs. When the heat generating element is energized to boil the ink, and the recording ink droplet is formed in response to the pressure resulting from the bubble creation, the ejected ink is generally divided into three droplets. The first is a main droplet constituting the main portion of the dot formed on the recording material, which is designated by a reference D1 in FIGS. 30 and 31. The second is a so-called satellite which is torn from the trail of the main droplet and which follows the main droplet in the form of a rod through the orifice. The satellite may be in some cases in the form of plural droplets and reaches the recording material to form a print dot. The satellite is designated by a reference D2 in FIGS. 30 and 31. Usually, the satellite droplet reaches the recording material substantially simultaneously with the main droplet, and therefore, is overlaid on the dot of the main droplet, thus constituting a significant part of the print dot. The third is the microdroplet designated in FIGS. 30 and 31 by a reference D3. The microdroplet is produced through the following process. When the bubble created by the applied heat is collapsed, the upstream ink and the downstream ink collide with the result of the shock wave of pressure starting from the collision point 2 in FIGS. 30 and 31, which wave gives a momentum to ink in the neighborhood of the meniscus. The momentum ejects the ink out.

The microdroplet D3 is ejected after the main droplet D1 and the satellite droplet D2 and the amount of ink contained therein is smaller than the main droplet D1 and the satellite D2. When there is a relative movement between the nozzle and the recording material with the structure of the nozzle shown in FIG. 30, the printed dot provided by the main and satellite droplets and the printed dot by the microdroplet, are separated on the recording medium, so they form discrete dots, with the result of degraded print quality. In the case that, as shown in FIG. 31, the main droplet and the satellite droplet eject along the central axis Z of the orifice, whereas the microdroplet ejects in the central direction of the nozzle which is different from the direction Z, the main droplet is ejected in the direction Z, but the microdroplet is ejected in a different direction, and therefore, the droplet positions are different on the recording material thus, the image quality is degraded by the deviation of the droplet deposition points.

In order to prevent the production of the microdroplet influential to the image quality. U.S. Pat. No. 5,148,192 which has been assigned to the assignee of this application has proposed that an extension, toward the ejection outlet, of the central axis of the liquid passage, crosses with the interval wall of the orifice plate. With this structure of the liquid passage, the microdroplet can be prevented, but there is a liability that the ink ejecting force is reduced.

As for the high speed recording and the high speed driving of the recording head among the problems described hereinbefore, there is an improvement in the refilling of the ink.

FIG. 29 shows a schematic longitudinal section of the nozzle of a conventional thermal ink jet recording head. It comprises a heat generating resistor 1 on a side of an ink passage 2, and the heat generated thereby acts on the ink filled in the ink passage 2. Then, the ink on the heat generating resistor 1 (heat acting portion 4) instantaneously changes its state (bubble creation), and a part of the in the passage is ejected through the ejection outlet 3 onto the recording material. The bubble created by the heat from the heat generating resistor 1 is collapsed and extinguished with discontinuance of the power supply to the heat generating resistor. Then, the ink passage 2 is filled with the ink (the ink refilling).

However, in the conventional recording head indicated by the solid lines in FIG. 29, after the termination of the heating by the heat generating resistor, the bubble continues to expand because of inertia even if the internal pressure of the bubble becomes negative. The expansion, due to the inertia of the bubble toward the upstream direction with respect to the direction of flow of the ink toward the ejection outlet, does not play any effective role, but pushes a large amount of the ink in the nozzle back into the liquid chamber with the result that the ink refilling period.

Thus, this is one of the causes which impede high speed recording. This tendency is strengthened with reduction of the area of the ejection outlet as compared with the passage and with the reduction of the angle formed between the ejection outlet direction and the liquid passage direction, since then the flow resistance against the ejection outlet side flow increases.

The pressure wave propagates toward the ejection outlet (downstream, direction B), and simultaneously it propagates toward the ink supply side (upstream, direction A) in the form of a backward wave. If the backward wave moving upstream is strong, it may reach the other nozzle or nozzles through the common liquid chamber which is disposed upstream of the nozzles and functions to supply the ink commonly to the nozzles. Then, there occurs a liability that the ejection in the other nozzle or nozzles are influenced.

In order to prevent the backward wave in the bubble creation, and in order to effectively use the bubble creating energy as the ejection energy, provision of flow resistance elements in the liquid passage has been proposed in Japanese Laid-Open Patent Applications Nos. 100169/1980, 204352/1985, 40160/1986, and U.S. Ser. No. 716832.

These proposals have paid much attention to the influence of the backward wave, but the consideration to the improvement in the refilling speed in order to meet the recent demand for high speed printing is not sufficient.

Furthermore, at the instance of the collapse of the bubble, the high pressure and the shock wave are produced, as described hereinbefore. The shock wave damages the heat generating resistor, thus reducing the service life of the recording head. Considerations to this problem has been paid in Laid-Open Japanese Patent Application No. 138460/1984 and U.S. Pat. No. 4,502,060. What they propose is that the bubble collapse position is shifted from the center of the heat generating resistor along a surface on which the heat generating resistor is disposed. When the damage to the electrode or the like connected to the heat generating resistor is considered, the proposal is not completely satisfactory.

SUMMARY OF THE INVENTION

Accordingly, it is a principal object of the present invention to provide a recording head and a recording apparatus having the same which is capable of high speed recording with high quality and with high durability.

It is another object of the present invention to provide a recording head and a recording apparatus having the same in which the structure of the liquid passage is improved so that the retraction of the meniscus and/or the direction of propagation of the shock wave due to bubble collapse is properly adjusted to control the microdroplet ejection direction and ejection state, thus permitting high quality image recording.

It is a further object of the present invention to provide a recording head and a recording apparatus having the same in which the retraction of the meniscus and/or the backward flow the liquid is suppressed, thus increasing the refilling speed to permit higher speed recording.

It is a further object of the present invention to provide a recording head and a recording apparatus having the same, which having such a structure that the bubble is prevented from expanding more than necessary, by which refilling is improved.

It is a further object of the present invention to provide a recording head and a recording apparatus having the same in which the liquid structure is such as to absorb the produced backward wave and the impact wave, by which the production of the microdroplet and/or the propagation of the pressure wave toward the upstream is prevented, and therefore, image quality deterioration attributable to it or them, can be prevented.

It is a yet further object of the present invention to provide a recording head and a recording apparatus having the same, which has an improved liquid structure with which the bubble collapse position (point) is shifted away from a plane including the heat generating resistor and/or the electrode, so that the head durability is improved.

According to an aspect of the present invention, there is provided a recording head comprising: a liquid ejecting outlet; a liquid passage communicating with the ejection outlet; and a heat generating resistor for supplying heat to the liquid in a heat acting portion in the liquid to create a bubble in the liquid passage to eject the liquid through said ejection outlet wherein a cross-sectional area of the liquid passage increases from the heat acting zone toward the ejection outlet.

According to another aspect of the present invention, there is provided a recording head comprising: a liquid ejecting outlet; a liquid passage communicating with the ejection outlet; and a heat generating resistor for supplying heat to the liquid in a heat acting portion in the liquid to create a bubble in the liquid passage to eject the liquid through the ejection outlet. The liquid passage is provided with a throat in the heat acting zone to provide a local minimum cross-sectional area of the liquid passage.

These and other object, features and advantages of the present invention will become more apparent upon consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described.

Figure 1:
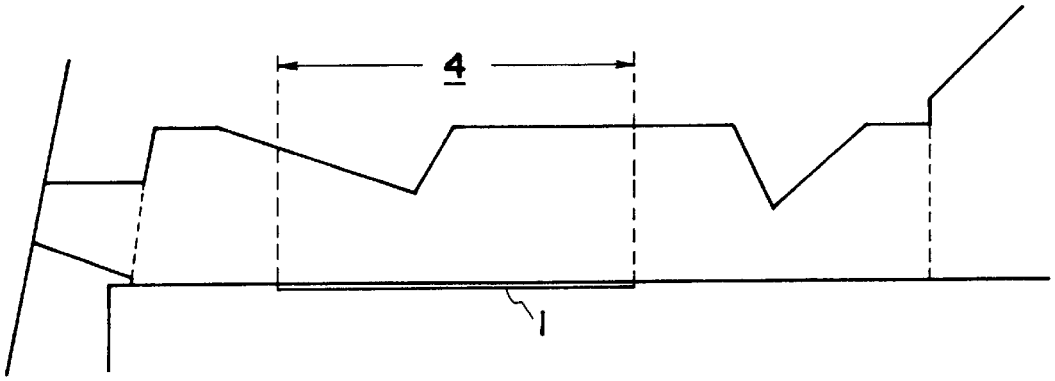
FIG. 1 is a sectional view of a recording head according to an embodiment of the present invention.

Referring to FIG. 1, there is shown a longitudinal sectional view of the liquid passage of an ink jet recording head according to an embodiment of the present invention. The liquid passage structure shown in FIG. 1 is effective to achieve a plurality of objects, but various portions thereof have respective functions, and as a whole, the objects are accomplished in combination.

Figure 31A:
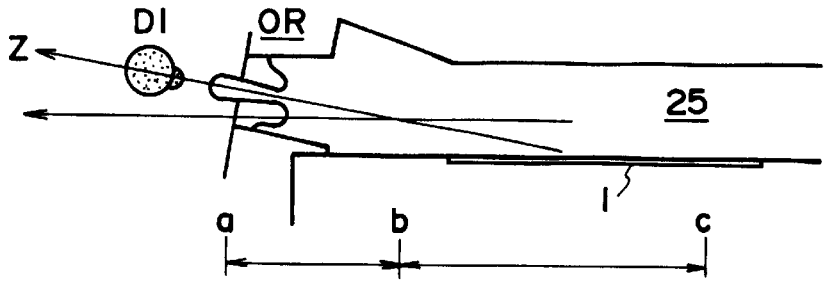
FIG. 31A PRIOR ART
FIGS. 31A, 31B and 31C illustrate the liquid ejection in conventional recording head.
Figure 31B:
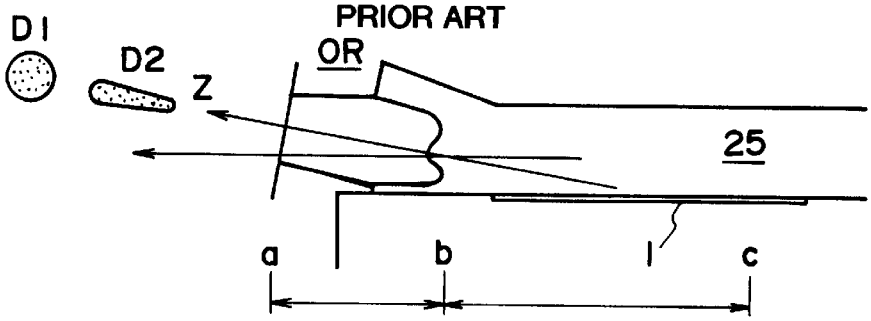
FIG. 31B PRIOR ART
Figure 31C:
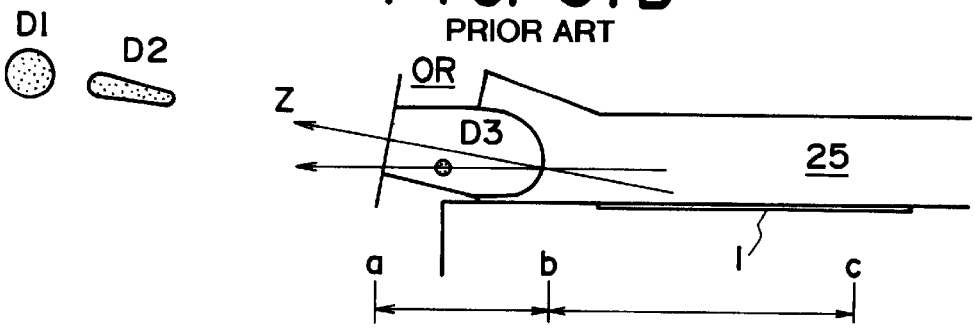
FIG. 31C PRIOR ART

The control of the liquid droplet ejecting direction will first be described. The inventors have investigated the difference in the ejection directions of the microdroplets and the main droplets, and have found the following. Since the ink constituting the main droplet is present adjacent the orifice (a–b) immediately before the bubble creation, as shown in FIG. 31, the ejecting direction of the main droplet is largely influenced by the configuration of the orifice (OR) portion, and therefore, the direction is substantially along the central axis Z. On the other hand, the microdroplet D3 is produced, at the time of the bubble collapse, the meniscus (position b) which is at the most retracted position. The most retracted position appears upon the extinction of the bubble, wherein the delay due to the propagation of the shock wave can be neglected. In this most retracted state of the meniscus, the ink is not contact with the orifice portion (OR), and therefore, the configuration of the orifice position (OR) does not greatly influence the microdroplet ejection direction. Since the microdroplet is produced by when and the shock wave starting at the bubble collapse position (position d) which hits the meniscus at the position b, the direction of the microdroplet is largely influenced by the direction of propagation of the shock wave.

Figure 32:
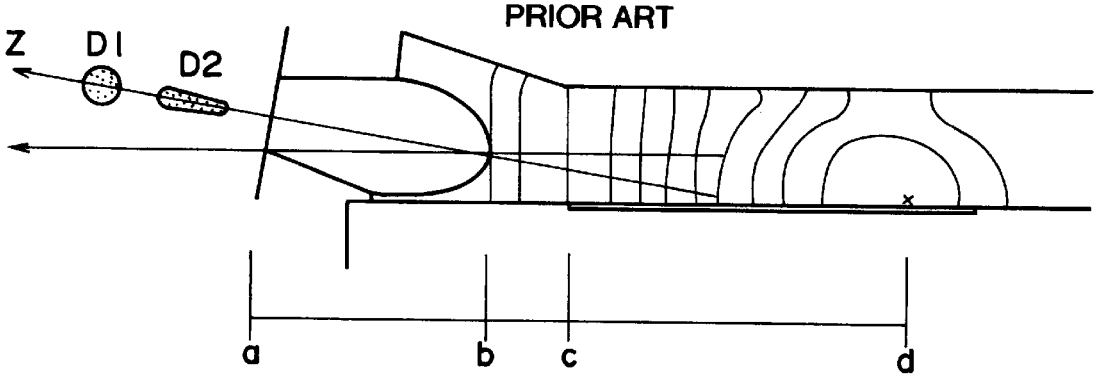
FIG. 32 PRIOR ART
FIG. 32 illustrates the pressure distribution in a conventional recording head.

FIG. 32 shows how the shock wave propagates, and is a isobar diagram showing the pressure distribution immediately after the collapse show the bubble. The isobaric lines of the shock wave starting from the bubble collapse point is first influenced by the configuration of the ink surface at which the body of the ink collide, and away from the collapse or colliding position (position c), they are influenced by the configuration of the liquid passage wall. The boundary condition here is that the isobaric lines of the pressure wave are perpendicular to the wall of the liquid passage. In other words, the vector of the velocity of the ink flow is zero along the wall surface on the wall of the nozzle wall. Therefore, when the distance between the positions c and d is long, the isobaric lines of the shock wave in the neighborhood of the position c become perpendicular to the nozzle central axis between the positions c and d. Because of the divergence of the passage between the positions c and d, the upper part of the isobaric lines slightly changes, but at the position b (retracted meniscus position), the isobaric lines are substantially the same as those characterized between the positions c and d. The flow of the ink is in the direction of the maximum change direction of the pressure distribution. Therefore, the momentum of the microdroplet produced at the meniscus position b is directed perpendicular to the tangential lines of the meniscus and of the isobaric line at the position b, that is, along the central axis Z of the nozzle between the positions b and c. In addition to the delay of the microdroplet formation from the main droplet, the direction of the ejection is different from the direction of the main droplet in the case where the direction of the central axis of the orifice is different from the central axis of the nozzle adjacent the bubble collapse point. In this case, therefore, the dot printed by the main droplet and the satellite droplet, and the dot printed by the microdroplet, are significantly deviated on the recording material, with the result of remarkable print quality deterioration.

From another standpoint, the ejection directions of the microdroplets are varied significantly. The causes of the variations have been investigated, and it has been found that the variations result from variations of the meniscus during the recording operation due to various unstable factors.

On the basis of the investigations, the following has been considered.

Figure 2:
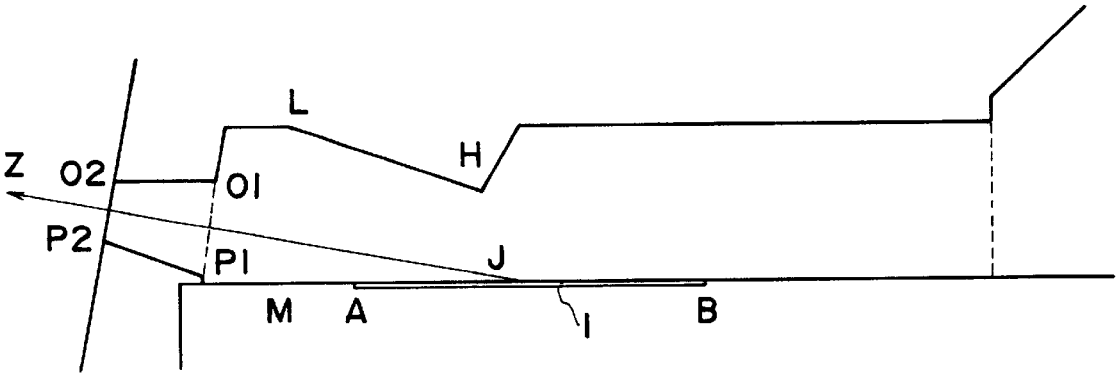
FIG. 2 is a sectional view of a recording head in which the shock wave is controlled, according to an embodiment of the present invention.

FIG. 2 is a longitudinal sectional view of the liquid passage in which the ejection direction of the liquid droplet is controlled. In this Figure, the ejection outlet is defined by O1-O2-P2-P1-O1, and an external opening of the ejection outlet is defined by O2-P2. Between positions A and b, a heater extends in the direction perpendicular to the sheet of the drawing. In this Figure, the main droplet and the satellite droplet are ejected by driving the heat generating resistor, that is, the heater substantially along the axis Z. In this embodiment of the invention, the structure of adjusting the nozzle axis behind the orifice is constituted by the passage defined by a line LH and a line MJ in the Figure. In this embodiment, a bisector of the angle formed between the lines LH and MJ is substantially along the orifice central axis. This is not inevitable, but is finely adjusted for the individual cases, since the print quality of dependent on the other structure of the nozzle, the nature of the liquid, the relative speed between the nozzle unit and the recording material or the like.

Figure 3:
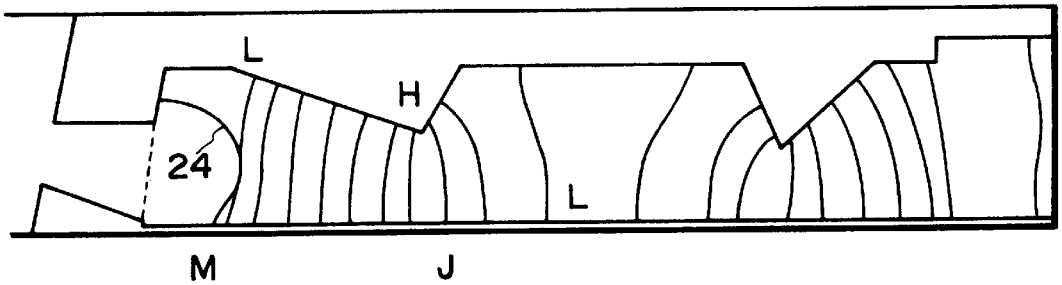
FIG. 3 shows a pressure distribution in the recording head according to an embodiment of the present invention.

FIG. 3 is an isobar diagram immediately after the bubble collapsed, obtained using computer simulation, and it will be understood from this diagram that lines perpendicular to the isobar lines are substantially toward the orifice. In other words, in the region between the line LH and the line MJ, the isobar lines are inclined as compared with the case of the conventional liquid passage, so that each line perpendicular to the isobar line contacting the meniscus 24 is directed through the orifice.

Thus, by correcting the propagation of the shock wave resulting from the bubble collapse (collision of liquid surfaces) by which the direction of microdroplet ejection is made to be the same as the direction of the main droplet and the satellite droplet. Therefore, the print quality can be significantly improved without decreasing the ink ejection speed. The structure and the function for correcting the propagation of the shock wave can be further described in the liquid passage of FIG. 1.

Figure 4:
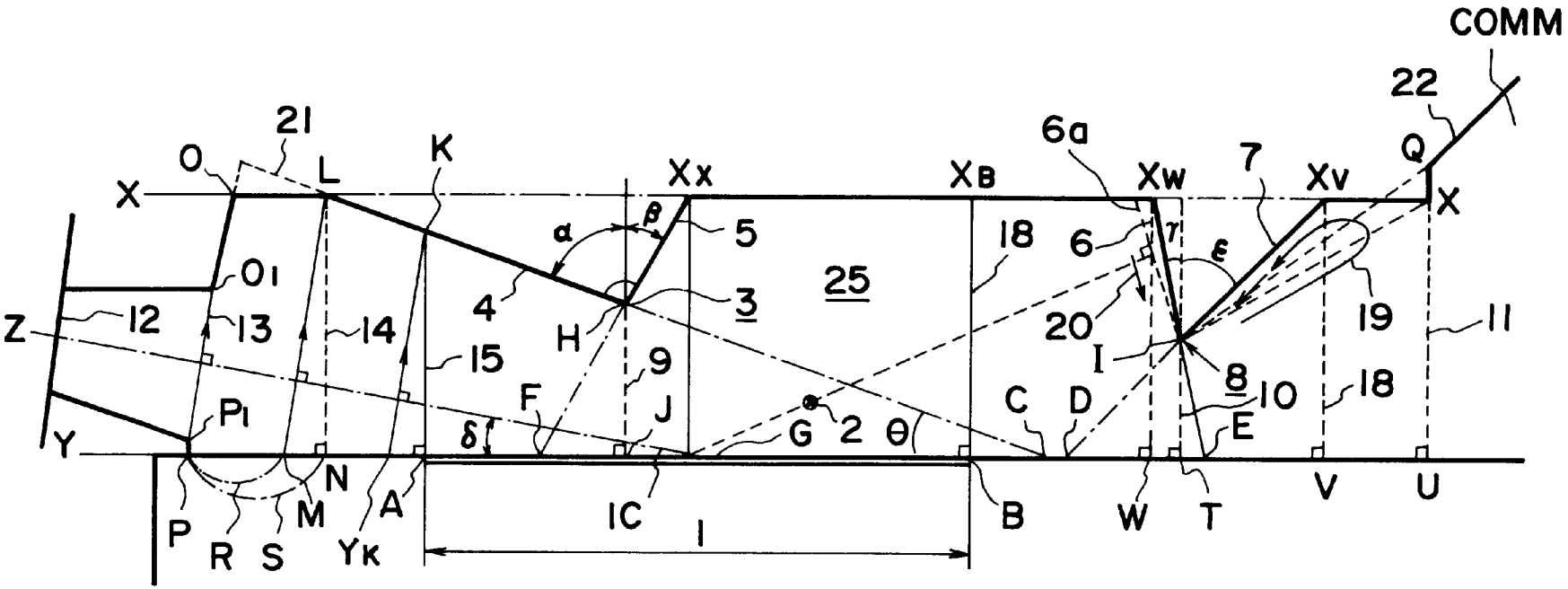
FIG. 4 is a diagram illustrating the structure of the recording head according to an embodiment of the present invention.
Figure 5:
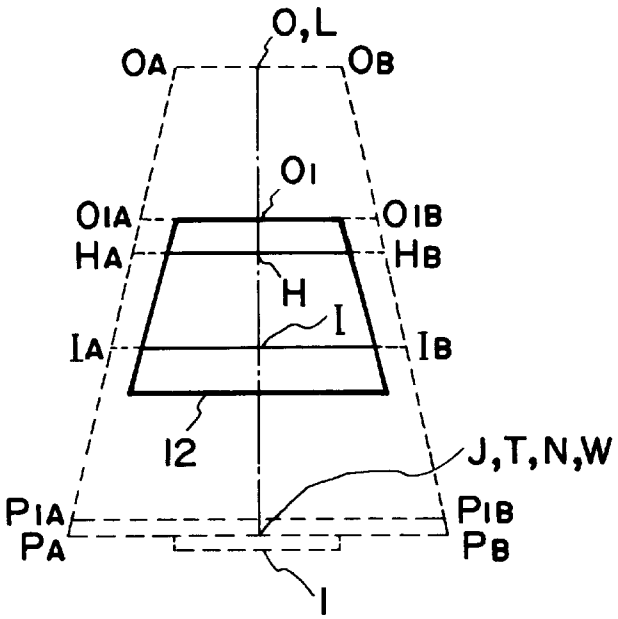
FIG. 5 is a cross-sectional view of the recording head according to an embodiment of the present invention.
Figure 6:
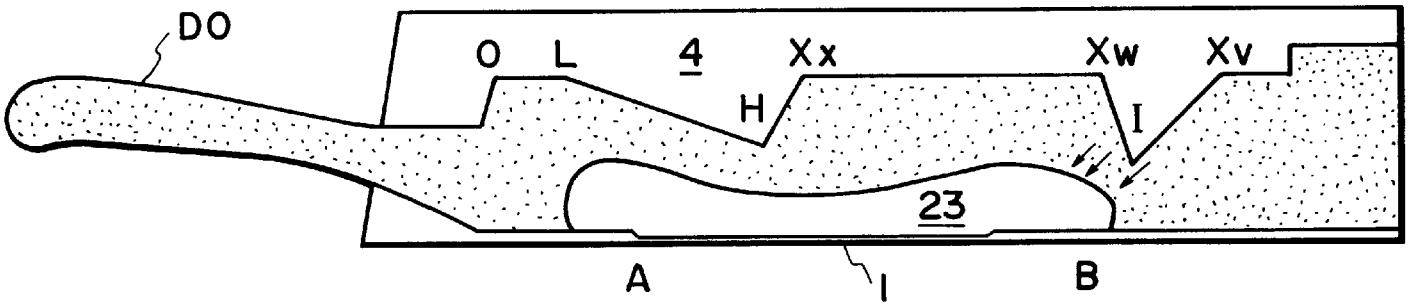
FIG. 6 illustrates the ink ejection in the recording head according to an embodiment of the present invention.

FIG. 4 shows in detail the structure of the liquid passage of FIG. 1. FIG. 5 is a cross-sectional view of various longitudinal position of the liquid passage perpendicular to the axis of the liquid passage provided with the heat generating resistor 1. FIG. 6 shows the maximum expansion of the bubble in the passage of FIG. 4. The description thereof is for this embodiment, and thus is not intended to particularly limit the present invention.

The liquid passage 25 connecting the ejection part defined by the outer opening 12 and the inner opening defined by O1-P1 and the liquid chamber (common chamber) COMM for containing the liquid to the supplied to the heat generating resistor 1, is provided to correct the shock wave produced by the bubble collapse. In the following description, the heat generating resistor 1 side is taken as a bottom side. However, this is not limiting. The ejection side of the liquid passage 25 will be described.

As shown in FIG. 5, the various portions of the liquid passage 25 have configuration of symmetric trapezoid configuration, so that the width of the cross-section increases symmetrically from the top side toward the heat generating resistor 1. The symmetric center extends between the centers of the bottom and top sides of the trapezoid, and a set of the lines connecting the central points defines a central plane of the liquid passage, and the central surface of the liquid passage is as shown in FIG. 4.

Figure 7:
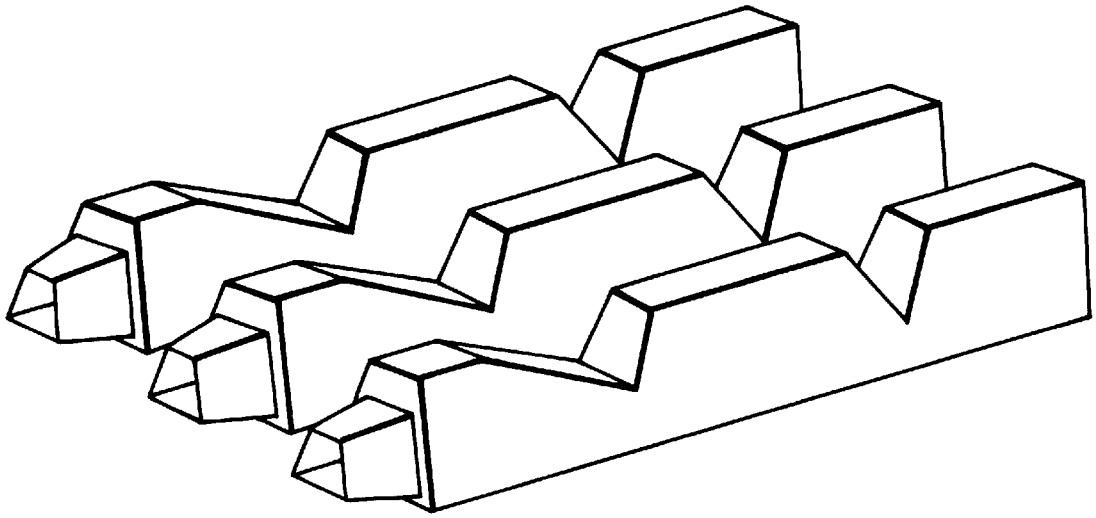
FIG. 7 is a perspective view of a multi-nozzle structure of a recording head according to an embodiment of the present invention.

FIG. 7 is a perspective view showing the interval configuration of the liquid passage. In FIG. 4, the ejection outlet reference center line Z passes through the center of the external opening of the ejection outlet and the center of internal opening O1-O2. The shock wave correcting portion 4 is constituted by a wall surface HL. A cross-sectional area of the passage is considered which is taken on a plane perpendicular to the ejection outlet central axis Z (or the surface area YU having the electrothermal transducer element with electrode (not shown) and the heat generating resistor and preferably with the protection level. The inclined surface HL is effective to monotonously increase the cross-sectional area from a region HJ (shock wave regulating portion 9 which will be described hereinafter) in the heat generating resistor portion or the heat acting portion $KABX_BX_XH$ toward the ejection outlet (LN or LM). The shock wave correcting zone is defined by plane HF, an inclined surface HL in a liquid passage region including a part of the surface area YU and a plane LN which is perpendicular to the heat generating resistor surface Y and which passes through a line L which is an ejection side end of the inclined surface (preferably a plane LM which is parallel to the ejection side surface O1-P1 and passing through a line L). This zone contains the maximum retracted position of the meniscus when the meniscus retracted most (substantially simultaneous with the collapse of the bubble). The maximum retracted position of the meniscus is substantially determined by the size of the bubble produced on the basis of the resistance of the heat generating resistor 1 and the electric energy supplied thereto, and the liquid passage upstream of the ejection outlet. This can be easily determined because the proper cross-sectional area of the liquid passage, the liquid and the driving pulse are selected to be within a limited range in the usual ink jet recording head.

In the shock wave correcting zone having the surface HL which is the shock wave correcting plane 4, the shock wave front, after passing through the shock wave regulating portion 9, is corrected to be substantially perpendicular to the reference axis Z. As described hereinbefore, the isobar lines cross perpendicularly with the wall of the passage. Since the surface HL is inclined relative to the surface YU, the inclination of the shock wave is corrected, as shown in FIG. 3.

It is noteworthy that the shock wave is sufficiently corrected by the shock wave correcting portion. From this standpoint, the shock wave correcting portion has a large length in the region downstream of the heat generating resistor, but if the downstream length is too long, the ink ejection speed decreases, with the result that the image quality deteriorates. In addition, the correction is easy in the region near the bubble collapse position. In view of this, it is preferable that the shock wave correcting portion starts at the position above the heat generating resistor 1 (heat acting portion).

In the above-described manner, the corrected shock wave hits the center of the meniscus when it is retracted most, and therefore, the microdroplet ejecting direction can be made the same as the ejection direction of the main droplet and the satellite droplet.

With this structure, the shock wave is corrected to a substantial extent in the position of the plane (AK) at the ejection site end A of the heat generating resistor 1. In view of this, the shock wave correcting portion 4 may be constituted by the portion HK only, but in order to stabilize the ejection direction, the longer correcting portion 4 is desirable.

In the structure of FIG. 4, the shock wave is further corrected from a point K to the point L, and therefore, the traveling direction of the shock wave in the neighborhood of the plane LN is satisfactorily corrected to the substantially the same as the ejection direction of the main droplet.

The maximum retracted position of the meniscus is within the space defined by L, M and N in this embodiment. This is preferable because the wavefront corrected to be perpendicular to the difference central axis Z can stabilize the ejection direction of the microdroplet. The maximum retracted position of the meniscus may be placed in a space defined by a plane KYk passing through a line K and parallel with the plane LM, a plane AYk and a plane KA and, the ejection direction is controlled as compared with the conventional recording head.

One of the preferable conditions is that the plane HJ as the correcting portion starting plane is within a zone facing to the heat generating resistor 1 producing the shock wave. More preferably, the plane HJ is nearest the ejection side than the bubble collapse point 2. In FIG. 4, the solid line wall of the liquid passage 25 is indicated such that the cross-sectional area of the liquid passage is constant along the axis Z from the connecting portion OP with the ejection outlet to the plane LM. However, it is possible to extend the inclined surface HL as indicated by a reference 21 and by broken lines. This is also the shock wave correcting portion in this embodiment. The correction of the shock wave is mainly determined by the wave front of the shock wave resulting in the microdroplet, and therefore, the shock wave subsequent to that produced by the initial collision does not influence the microdroplet. In view of this, the configuration of the subsequent wave in the plane OL is not important. However, the provision of the extension 21 is effective to provide the desired state of collision even if the maximum retracted position of the meniscus changes more or less due to the change in the ambient conditions or another.

Generally, the retracted position of the meniscus varies to some extent. With the structure described above, however, the cross-sectional area of the liquid passage decreases from the region 14 having the inclined surface LM toward the heat generating resistor 1, more particularly toward the region 15 and region 9, and therefore, the direction of the liquid movement toward the buffer chamber as a result of the collapse of the bubble, is easily limited, and therefore, the retraction of the meniscus is more stabilized than in the prior art. As another example for stabilizing the meniscus retraction, the regions indicated by R and S are given the configurations shown in FIG. 8.

In the foregoing, the description has been made in terms of the problem arising from the microdroplet resulting from the shock wave, in connection with the inclined surface LH. The inclined surface LH of FIG. 4 has additional advantages, more particularly, the stabilization of the ejecting force for assuredly and efficiently ejecting the main droplet and the satellite droplet in the ejecting direction Z. This is because the region 9 which is the starting line of the inclined surface LH is disposed at the ejection outlet side in the neighborhood of a central portion 1C of the heat generating resistor 1 along the liquid path, and therefore, the ejecting force by the bubble toward the ejection side can be efficiently and effectively applied to the ejection side liquid.

Figure 8:
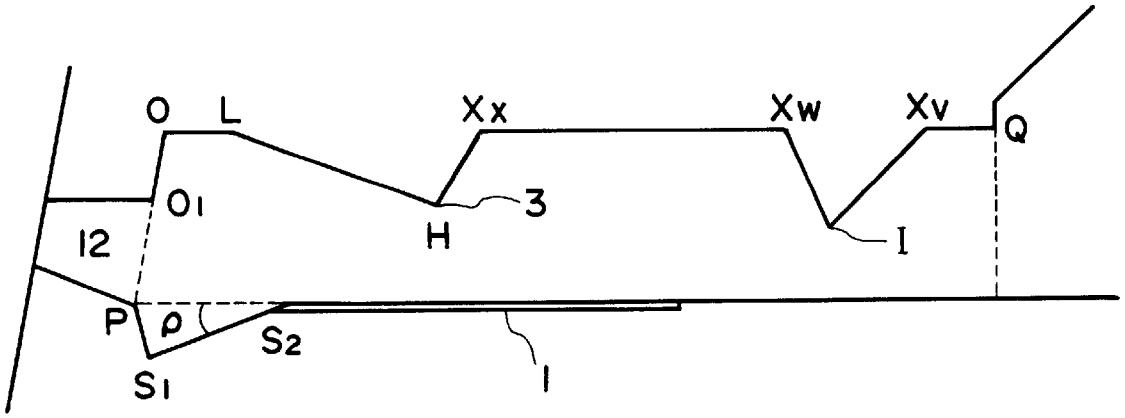
FIG. 8 is a sectional view of a recording head according to another embodiment of the present invention.
Figure 9A:
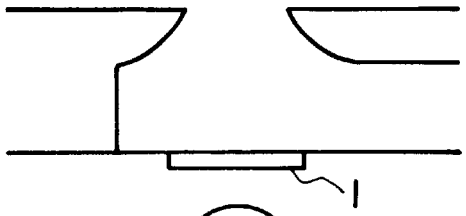
FIG. 9A PRIOR ART
FIGS. 9A, 9B, 9C, 9D, 9E and 9F illustrate the operation in a conventional recording head.
Figure 9B:
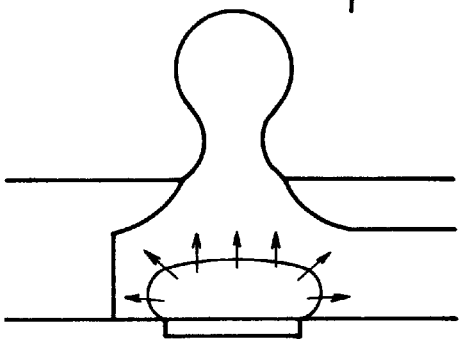
FIG. 9B PRIOR ART
Figure 9C:
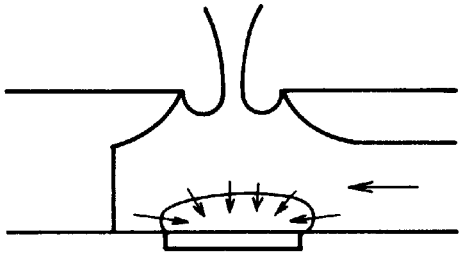
FIG. 9C PRIOR ART
Figure 9D:
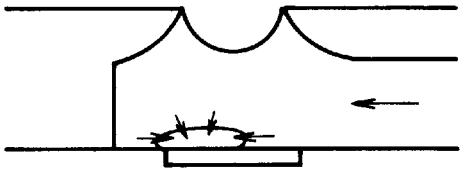
FIG. 9D PRIOR ART
Figure 9E:
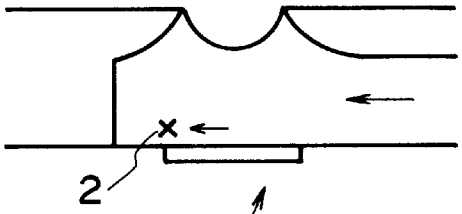
FIG. 9E PRIOR ART
Figure 9F:
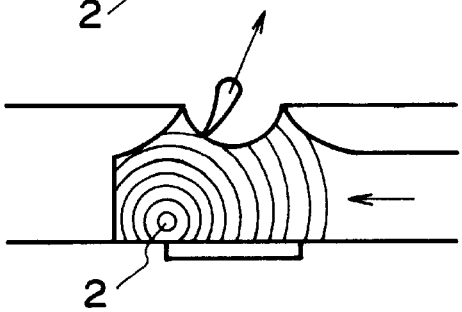
FIG. 9F PRIOR ART

Examples of configurations and figures of this embodiment will be described. All the above-described regions, ejecting part and the ejecting outlet 12 have the symmetric trapezoidal configuration in front view as seen from the ejecting outlet side, as shown in FIG. 5. It should be noted that the consideration is paid to the change in the configuration in the region ruling the shock wave and the pressure wave in the liquid passage. In the case of the symmetric trapezoidal configuration, the ruling surface is defined by the height component of the symmetric trapezoid, more particularly, the longitudinal sectional view taken along a plane passing through the centers of the top and bottom sides of the trapezoid, that is, as shown in FIG. 4. The case will be dealt with in which there are provided plural surfaces providing a relatively large cross-sectional area increase, for example, in which in plane of or in addition to the above-described shock wave correcting portion 4, the surface significantly increasing the cross-sectional area is only provided at one of the sides OAPA and OPPB. In this case, the position and the direction are determined in the case of 3 SUM of vectors to determine as the ruling plane the plane substantially ruling the liquid passage cross-sectional area. In the determination of the ruling plane, it is preferable the ruling plane rules the height component of the liquid passage in the zone having the heat generating resistor. In the embodiment of FIGS. 5 and 4, the side OAOB has a length of 25.5 $\mu$m; the side PAPB has a length of 58.5 $\mu$m; the height LN is 70 $\mu$m; and angle $\delta$ formed between the reference central axis Z of the ejection part and the surface Y having the heat generating resistor is 10 degrees; an angle $\theta$ formed between an extension of the inclined surface LH and the surface Y having the heat generating resistor at point C is 20 degrees (an angle $\alpha$ in FIG. 8 is 70 degrees); a height HJ is approximately 40 $\mu$m; a length AB of the heat generating resistor 1 is approximately 150 $\mu$m; a distance between points N and J is 82 $\mu$m; a distance between points A and J is 55 $\mu$m; a distance between points O and L is 26 $\mu$m; a distance between point N and P is 38 $\mu$m; a distance between points 1C and J is 17 $\mu$m. With these dimensions and configurations, the angular difference between the main droplet and the microdroplet is not more than several degrees, and therefore, even if the clearance between the ejection outlet of the recording head and the recording material is approximately 1 mm, the microdroplet deposition point is substantially within the feathering region of the main droplet. Otherwise, the microdroplet is continuous with the main droplet deposition area, and therefore, the formed image is clear and sharp. An intersection G between the central axis line Z and the above-described plane YU is on the heat acting surface, that is, the top surface of the heat generating resistor and is substantially at the center 1C of the heat generating resistor 1, but it is disposed closer to the liquid chamber COMM from the center 1C. The shock wave correcting portion may be defined, for example, as a zone having a shock wave regulating portion HJ disposed in the heat acting zone, a monotonically increasing cross-sectional area zone in which the cross-sectional area of the liquid passage monotonously increases along the reference central line from the regulating zone to the liquid ejecting zone. It is not necessarily concerned with the position of the bubble collapse point 2, but in order to provide the most advantageous effects, it is preferably disposed on the ejection site from the bubble collapse point.

An angle $\theta$ formed between the inclined surface 4 and the surface YU is preferably larger than the angle $\delta$ between the central axis of the ejection outlet and the surface YU by not less than 5 degrees, further preferably, not less than 10 degrees, since then the length of the liquid passage can be reduced without losing the advantageous effect described hereinbefore. A length of the inclined surface 4 is not less than 1, preferably, not less than 1.5 times the height HJ of the region 9. From the standpoint of stabilizing the meniscus formation, it is preferably larger than twice. In order to promote the shock wave correcting function, it is preferable that the bubble collapse portion 2 is in a space HCY defined by an extension of the inclined surface 4 and the heat acting surface. More preferably, the bubble collapse point 2 is not contained in the shock wave correcting zone; the correcting passage has a length JN larger than a distance between the bubble collapse point 2 and the regulating portion 9; and the most retracted meniscus after the liquid ejection in the normal state is in the correcting zone. This is because the ejecting energy is efficiently used for the movement of the liquid, and simultaneously, the length of the entire liquid passage can be reduced.

The cross-sectional area of the shock wave correcting region is preferably symmetrical, and in addition from the standpoint of easy motion of the liquid toward the ejection outlet, the width of the surface having the heat generating resistor is larger than the width of the side face thereto. Then, as sown in FIG. 4, the pressure is concentrated to the top side of the symmetrical trapezoid to increase the buffering effect to reduce the pressure resulting from the shock wave.

FIG. 9 is to describe the problems involved in the conventional structure in which the ejection outlet is faced to the heat generating resistor. A reference number 2 designates the bubble collapse point. In the conventional structure, the bubble collapse point is deviated as shown, and therefore, the microdroplet is ejected in the direction indicated in FIG. 9, (*f*).

Figure 10:
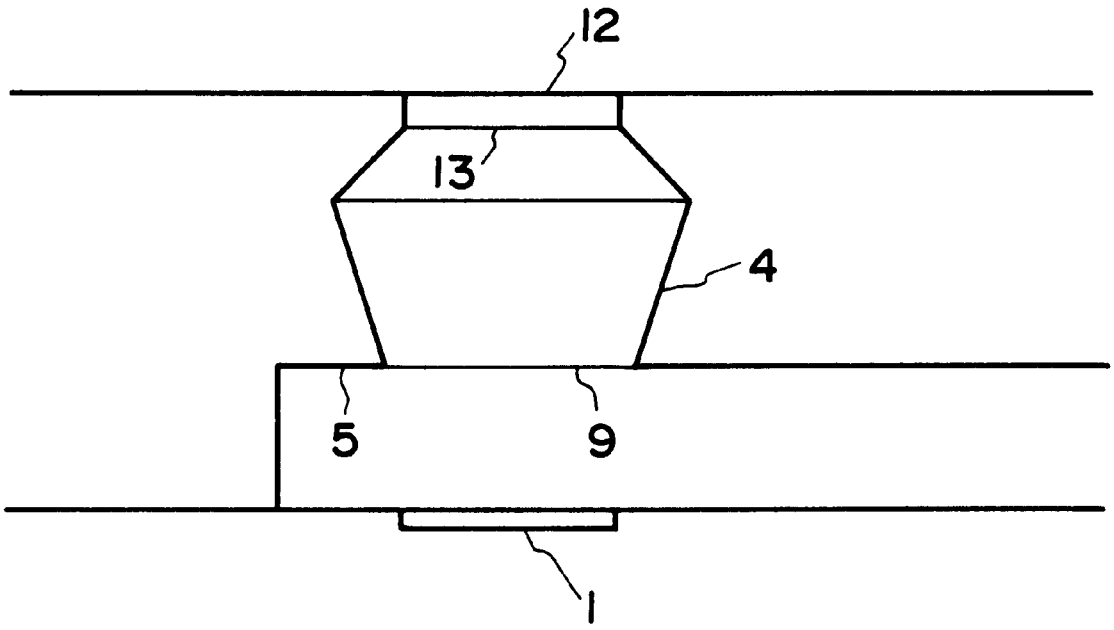
FIG. 10 is a sectional view of a recording head according to a further embodiment of the present invention.
Figure 11:
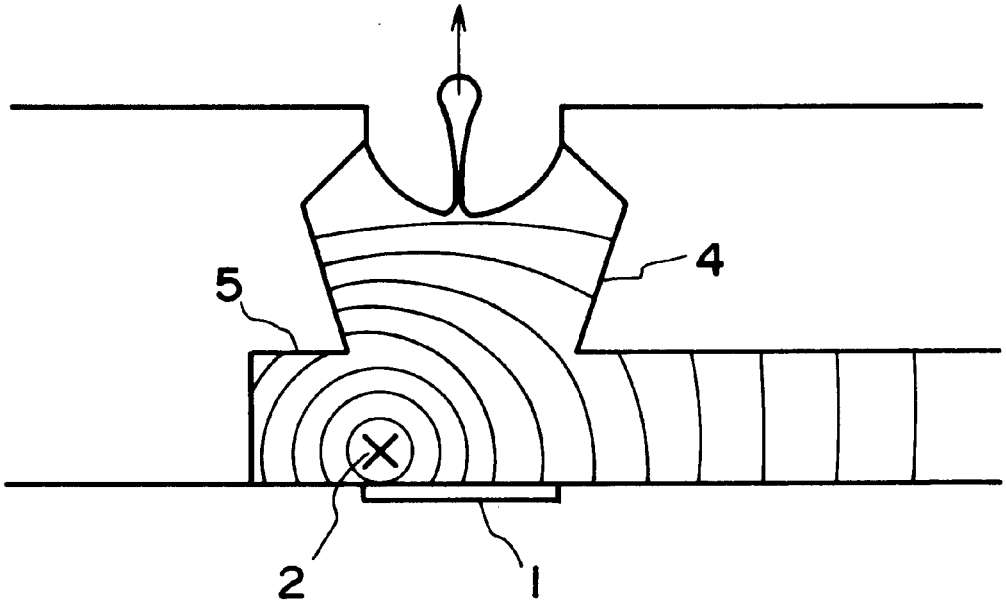
FIG. 11 illustrates the operation of the recording head of FIG. 10.

FIGS. 10 and 11 show a structure for avoiding this problem, which corresponds to another embodiment of the present invention. The liquid passage has a shock wave regulating portion 9 in which the cross-sectional area decreases and a monotonically increasing cross-sectional area zone having inclined surfaces at both sides. With this structure, the shock wave can be assuredly corrected even if the length is short.

FIG. 11 shows the correcting effect. The shock wave regulating zone 9 reduces the shock wave, and is corrected by the shock wave correcting portion 4. The thus corrected shock wave collides with the maximally retracted meniscus in the direction perpendicular to the center line of the ejecting portion, and therefore, the microdroplet is ejected in the direction of the arrow which is the detection of the main droplet.

Figure 12:
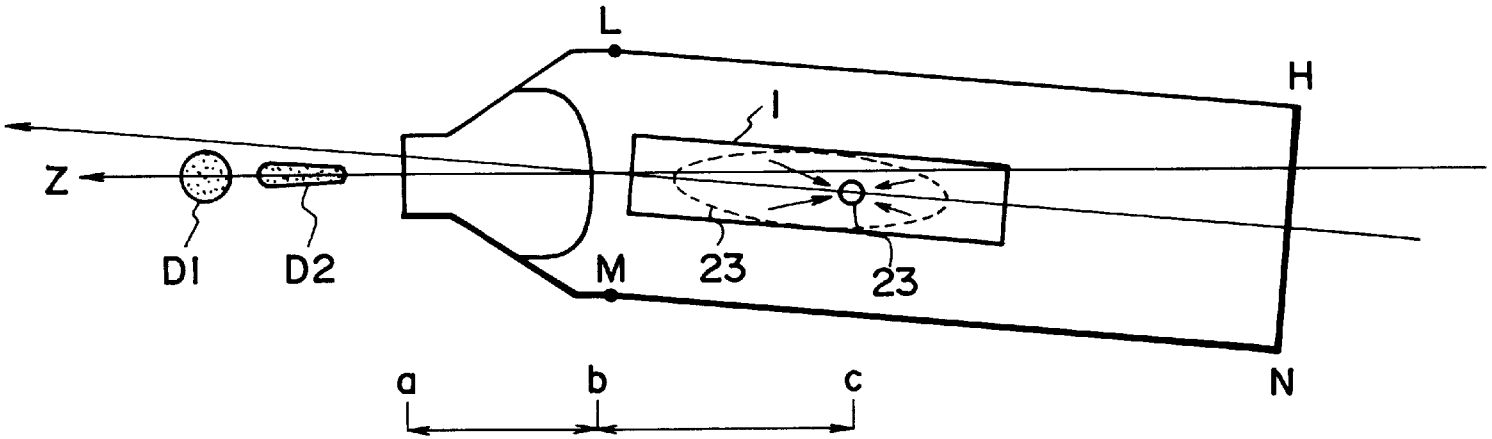
FIG. 12 shows a recording head according to a further embodiment of the present invention.
Figure 13:
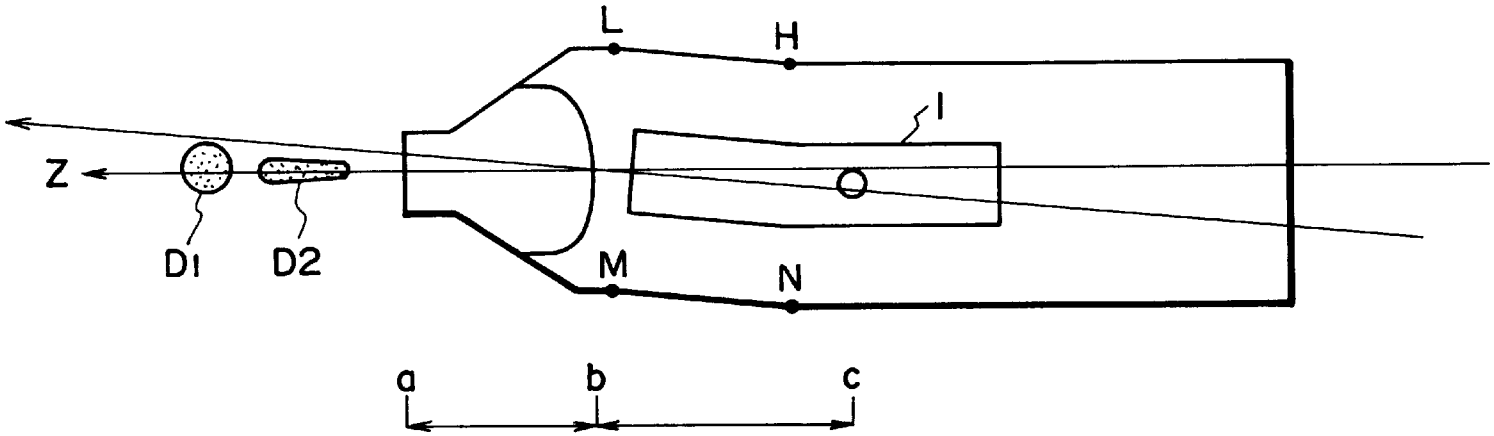
FIG. 13 shows a recording head according to a further embodiment of the present invention.

FIGS. 12 and 13 show a further embodiment of the present invention in which the microdroplet ejecting direction is deliberately different from the ejecting direction of the main droplet and the satellite droplet. Depending on the relative speed between the nozzle unit and the recording material, a positive angular deviation between these embodiments is desirable. In these embodiments, an angle formed between a central axis of the orifice portion (ab) and the central axis in the upstream zone (pc), is adjusted so as to adjust the ejection direction of the microdroplet in place of providing the tapered or horn-like walls of the liquid passage in the shock wave correcting portion 4 in the embodiment described hereinbefore. In these embodiments, the walls LH and MH are parallel with each other.

In the foregoing, the description has been made as to the structure for correcting the ejecting direction of the microdroplet.

The description will not be made as to control of bubble creation and collapse and a member for controlling the shock wave resulting at the time of bubble collapse to improve the refilling property and to control the production of the microdroplet.

The inventors' investigations in these respects have revealed the following. In order to improve the ink refilling, it would be considered that the liquid passage cross-sectional area is increased to reduce the liquid flow resistance so that the flow rate of the ink from the upstream side (A increases). However, if the liquid passage cross-sectional area is simply increased, the size of the bubble created increases with the result that the ink quantity to be supplied by the refilling action increases, and therefore, the refilling property is not improved. It has been found that the problem can be solved by increasing the ink passage and providing a local minimum point of the cross-sectional area at least at one position effective to control the bubble created in the heat acting zone of the ink passage and to control the shock wave or the like. The local minimum position may be called the throat or shock wave regulating portion.

It has further been found that by providing at least one throat (backward wave regulating portion) at least at one position upstream of the heat acting zone, further advantageous effects can be.

If these structure are used, the size of the bubble created is so regulated that the unnecessary backward motion of the ink upstream is suppressed, so that shorter refilling time is required. As compared with the case without the throat, the amount of liquid ejection and the speed thereof are significantly stabilized. This is because the improvement in the balance in the flow resistance of and the mass between the ejection outlet and the throat. Also, it has been confirmed that the service life of the heater is improved. The structure is effective to reduce the shock wave propagation to the ejection outlet, and therefore, the production of the microdroplet is reduced. The structure for accomplishing this will be described in detail.

Figure 14:
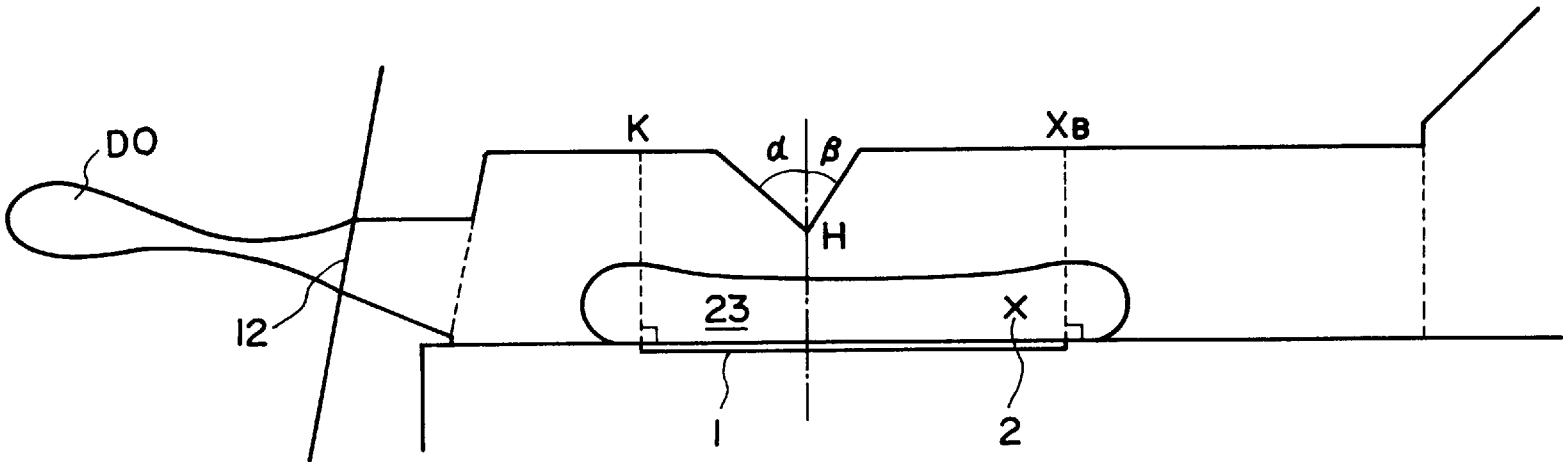
FIG. 14 is a sectional view of a recording head according to a further embodiment of the present invention, in which the recording head is provided with a throat.

FIG. 14 is a longitudinal sectional view of a further embodiment. FIG. 14 is a central longitudinal sectional view when the bubble is created. In this Figure, a reference numeral 1 designates a heat generating resistor, and D0 designates the ink which is going to be ejected through the ejection outlet 12 by the bubble creation, and 2 designates the bubble collapse point at which the bubble 23 finally collapses or disappears.

Generally, in the nozzle of the ink jet recording apparatus, in order to eject the liquid droplet efficiently through the ejection outlet, the ink mass and the flow resistance are smaller on the ejection side of the heat generating resistor 1 than on the upstream side thereof. As a result, the motion of the ink at the time of the bubble collapse is influenced thereby, and therefore, the bubble collapse point is upstream of the center of the heater length.

In this embodiment, the local minimum of the cross-sectional area of the ink passage is disposed above the heat generating resistor and ejection side of the bubble collapse point 2. The provision of the local minimum (HJ of the cross-sectional area is effective to divide the energy resulting from the bubble creation into the ejection side downstream side) and the upstream side. Further, by inclining the surface toward the ejection outlet as shown in the Figure, the bubble expanding energy toward the top can be deflected toward the ejection outlet, thus increasing the ink ejection speed. An angle $\alpha$ constituting partly the local minimum H is preferably large to some extent from the standpoint of directing the bubble expansion energy to the ejection outlet, that is, from the standpoint of the upward component of the bubble expansion energy more to the ejection outlet side than toward the upstream. On the other hand, in order to decrease the energy transmitted upstream, an angle $\beta$ is preferably small. In view of the above, $\alpha>\beta$ is preferable. It is also desirable that the ink passage cross-sectional area monotonically increases from the local minimum H toward the ejection outlet. During the bubble collapsing period, the ink flows toward the collapse position from the upstream and downstream of the ejection heater with the reduction of the volume of the bubble 23. In this embodiment, the local minimum is in the ejection side zone from the bubble collapse point, and therefore, during the bubble collapse period, the ejection side surface LH (FIG. 4) of the local minimum point gives the flow resistance against the ink flow from the ejection outlet side. Therefore, the amount of meniscus retraction after ejection can be reduced, and therefore, the amount of ink required for filling the passage up to the front side of the nozzle can be reduced.

In the case where the local minimum H is disposed at the ejection outlet side of the bubble collapse point, the ink flowing to the bubble collapse point from the ejection outlet side during the collapsing period of the bubble, passes through the local minimum cross-sectional area, and produces eddy or turbulent current at the upstream side of the local minimum portion (in the neighborhood of the surface XXH in FIG. 4). This is effective to suppress the upward motion of the ink, so that the refilling property is further increased, and in addition the eddy or turbulent flow functions to weaken the impact force at the time of the bubble collapse, and therefore, the service life of the heat generating resistor can be increased.

In order to produce the turbulent flow at the upstream side of the local minimum at the time of the bubble collapse, it is preferable that the cross-sectional area increasing rate in the area downstream (ejection side) of the local minimum is larger than that in the upstream side. Therefore, the angles $\alpha$ and $\beta$ satisfy $\alpha>\beta$.

By the provision of the local minimum of the ink passage cross-sectional area at the downstream side from the bubble collapse point, a part of the shock wave produced by the bubble collapse propagating toward the ejection outlet can be reflected and reduced by the surface upstream of the local minimum point (shock wave reducing region, surface XXH in FIG. 4). By doing so, the production of the microdroplets due to the shock wave can be reduced.

In order to provide the above-described advantageous effects, the local minimum position is preferably above the heater.

Figure 15:
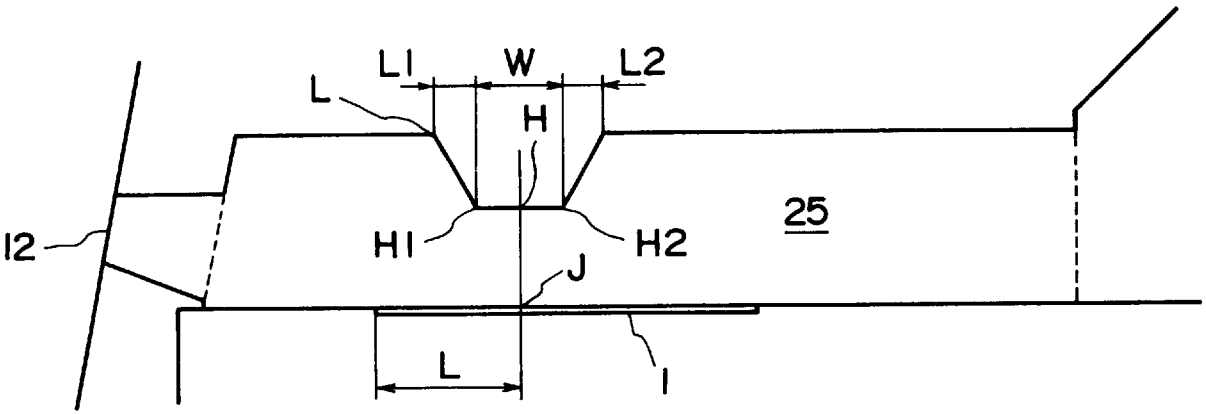
FIG. 15 is a sectional view of a recording head according to a further embodiment of the present invention.

The configuration of the local minimum providing portion above the heater may have an apex, as shown in FIG. 14, or may be trapezoidal as shown in FIG. 15. In the case of the trapezoidal configuration as shown in FIG. 15, the throat position is defined as a center H on the top surface of the trapezoid (minimum cross-sectional area position).

The configuration of the throat (minimum cross-sectional area position) is further investigated.

FIG. 15 is a sectional view of a nozzle including an external opening 12 of the ejection outlet, a heat generating resistor 1 and an ink passage 25 which is connected with other nozzles through a common liquid chamber.

Various dimensions of the nozzle in this embodiment are as follows. The nozzle length is 350 $\mu$m; a nozzle cross-sectional area is 3200 $\mu m^2$; an area of an external opening of the ejection outlet is 900 $\mu m^2$; a heater length is 150 $\mu$m; a cross-sectional area S of the opening in the throat HJ is 200–3000 $\mu m^2$; throat position L (a distance from the ejection side end of the ejection heater to the point J) is 0–250 $\mu$m; the width W of the throat 0–150 $\mu$m; a length L1 of the front sectional area changing portion (the shock wave correcting portion described hereinbefore) is 0–150 $\mu$m; a length L2 of a backward sectional area changing portion (shock wave reducing portion) is 0–150 $\mu$m. The above dimensions given in ranges mean that the dimensions are changed in the range.

The nozzles having various dimensions are as follows:

TABLE 1

| Nozzle | Throat position (L) | Throat length (W) | Front part L1 | Rear part L1 | Throat area (S) |
|---|---|---|---|---|---|
| 1 | 75 | 30 | 30 | 30 | 3000 |
| 2 | " | " | " | " | 2800 |
| 3 | " | " | " | " | 1600 |
| 4 | " | " | " | " | 400 |
| 5 | " | " | " | " | 200 |
| 6 | 0 | " | " | " | 1600 |
| 7 | 30 | " | " | " | " |
| 8 | 120 | " | " | " | " |
| 9 | 150 | " | " | " | " |
| 10 | 75 | 0 | " | " | " |
| 11 | " | 60 | " | " | " |
| 12 | " | 90 | " | " | " |
| 13 | " | 150 | " | " | " |
| 14 | " | 30 | 0 | " | " |
| 15 | " | " | 60 | " | " |
| 16 | " | " | 90 | " | " |
| 17 | " | " | 150 | " | " |
| 18 | " | " | 0 | " | " |
| 19 | " | " | 60 | " | " |
| 20 | " | " | 90 | " | " |
| 21 | " | " | 150 | " | " |

The nozzles number 1–5 commonly have the throat position length L of 75 $\mu$m, the throat length W of 30 $\mu$m, the front area changing portion length L1 of 30 $\mu$m, and the rear area changing portion length L2 of 30 $\mu$m, and the throat area was changed 200–3000 $\mu m^2$.

The nozzles number 3, 6–9 commonly had the throat area S of 1600 $\mu m^2$, the throat length W of 30 $\mu$m, the front area changing portion length L1 of 30 $\mu$m, and the rear area changing portion length L2 of 30 $\mu$m, and the throat position distance L was changed between 0–150 $\mu$m.

The nozzles number 10–13 commonly had the throat area S of 1600 $\mu m^2$, the throat position distance L of 75 $\mu$m, the front area changing portion length L1 of 30 $\mu$m, and the rear area changing portion length L2 of 30 $\mu$m, and the throat length W was changed between 0–150 $\mu$m.

The nozzles number 14–17 commonly had the throat area S of 1600 $\mu m^2$, the throat position distance L of 75 $\mu$m, the throat length W of 30 $\mu$m, and the rear area changing portion length L2 of 30 $\mu$m, and the front area changing portion length L1 was changed between 0–120 $\mu$m.

The nozzles number 18–21 commonly had the throat area S of 1600 $\mu m^2$, the throat position distance L of 75 $\mu$m, the throat length W of 30 $\mu$m, and the front area changing portion length L2 of 30 $\mu$m, and the rear area changing L1 was changed between 0–120 $\mu$m.

The nozzles number 22 and 23 did not have the throat as in the conventional nozzle (solid lines in FIG. 29), and the cross-sectional area was simply increased (FIG. 29, broken lines) as comparative examples.

The 23 recording heads were manufactured, operated and evaluated from the standpoint of the maximum bubble volume and the ink refilling time required.

Figure 16:
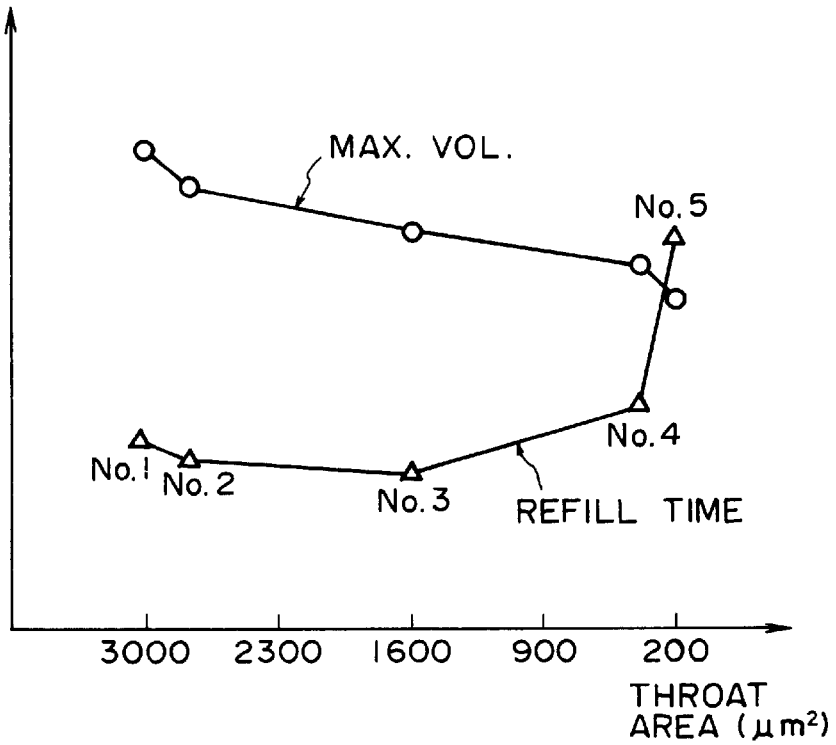
FIG. 16 shows results of tests of the nozzle according to an embodiment of the present invention in which the cross-sectional area of the throat is changed.
Figure 17:
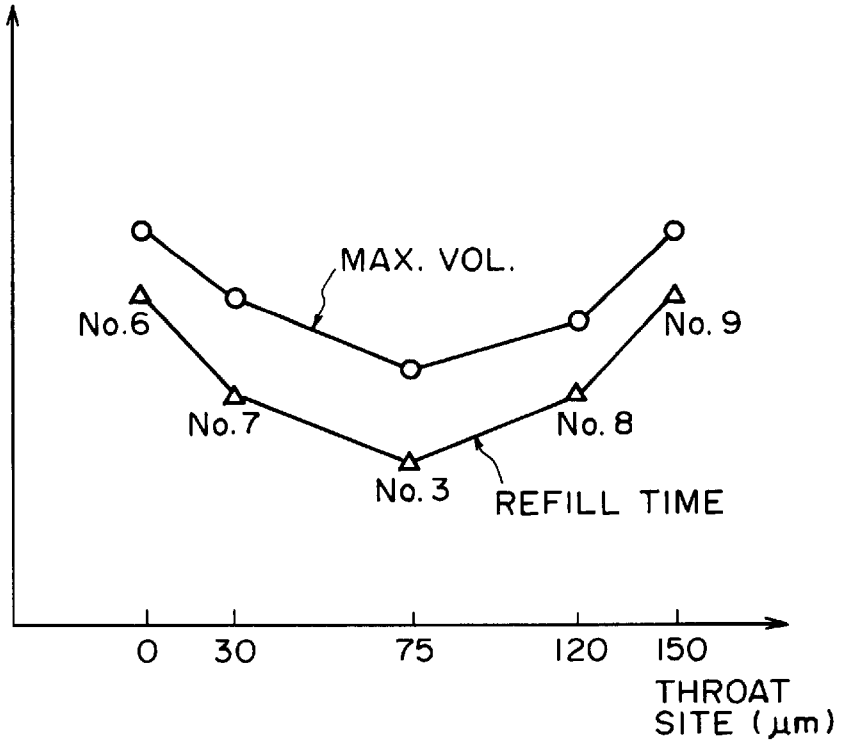
FIG. 17 shows results of tests of a nozzle according to the present invention in which the throat position is changed.

FIG. 16 shows the evaluations of the nozzles number 1–5 in which the throat area was changed in the range between 200–3000 $\mu m^2$. With the reduction of the throat area S2, the maximum bubble volume is decreased. Below 400 $\mu m^2$ of the throat area S2, the refilling period is increased, probably because of the increase of the resistance against flow by the local minimum of the flow area. Therefore, the tolerable range of the throat area is 400–2800 $\mu m^2$. As the ratio to the nozzle sectional area S1, 1/8–7/8 is desirable. From the standpoint of the refilling time and the shock wave correcting effect described hereinbefore, the throat area is preferably not less than 40% and not more than 80% of the cross-sectional area at the bubble collapse position, practically. Further preferably, it is larger than 50% and not larger than 70%. Also, it is preferable that the throat area is preferably kept out of contact with the created bubble. As compared with the nozzle number 22, the nozzle without the throat having a large flow resistance in the nozzle requires a large refilling time as between that of No. 4 nozzle and that of No. 5 nozzle. As compared with the nozzle No. 23, the nozzle having the expanded flow passage showed substantially the same refilling as the nozzle No. 1.

FIG. 12 shown the evaluations of the nozzles Nos. 6–9 in which the throat position distance L is changed in the range between 0–150 $\mu$m. With the increase of the throat position distance L, the maximum bubble volume and the refilling time are decreased, but when it reached the backside of the heat generating resistor, the maximum volume of the bubble and the refilling time increased. It is considered that this is because the bubble expansion suppression changes, and similarly the refilling nature also changes, and also because of the increase of the flow resistance at the local minimum position. Since the bubble collapse position is behind the heat generating resistor, the throat position distance L is preferably in front of ½ position of the length of the heat generating resistor. Therefore, the optimum range is 30–120 82 m. As a ratio to the length of the heat generating resistor, it is preferably ⅕–4/5, further preferably ⅕–2/5.

Figure 18:
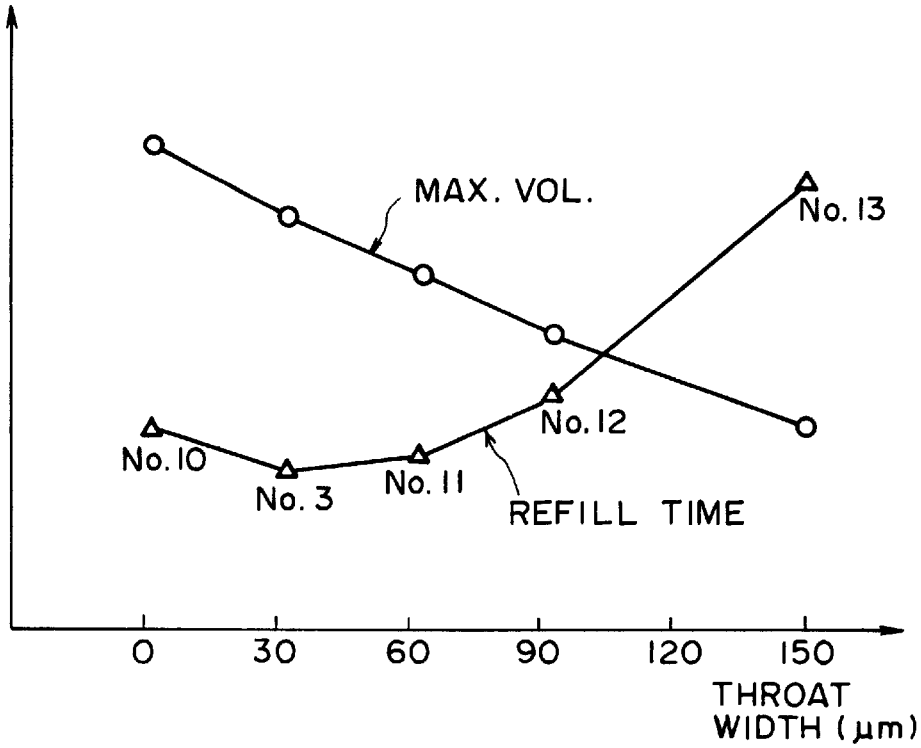
FIG. 18 shows results of tests of a nozzle according to the present invention in which the throat width W is changed.

FIG. 18 shows the evaluations of the nozzles 10–13 in which the throat length was changed in the range between 0–150 μm. With the increase of the throat length, the maximum volume of the bubble decreases. However, when the throat length W is not less than 100 μm, the refilling time increases, the reason for this is considered to be an increase in the flow resistance. Accordingly, the optimum range of the throat length W is 0–90 μm, and as a ratio relative to the heat generating resistor, it is preferably 0–¾.

Figure 19:
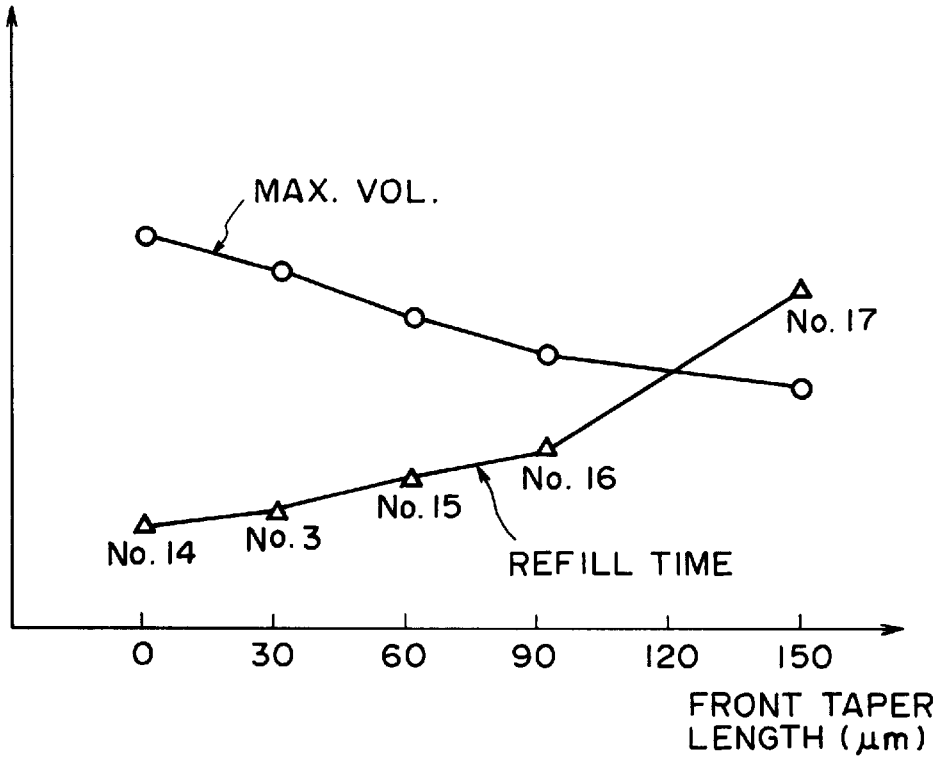
FIG. 19 shows results of test of the nozzles of the present invention in which the forward cross-sectional area changing portion is changed.

FIG. 19 shows evaluations of nozzles No. 14–17 in which the front area changing portion length L1 is changed in the range between 0–150 μm. With the increase of the front area changing portion length L1, the maximum volume of the bubble decreases. When, however, the front area changing portion length L1 exceed 90 microns, the refilling time increases. The reason for this is considered to be the increase of the flow resistance by the area changing portion. Accordingly, the optimum range of the front area changing portion length is 0–90 μm, and as the ratio to the heat generating resistor, it is preferably 0–⅗.

Figure 20:
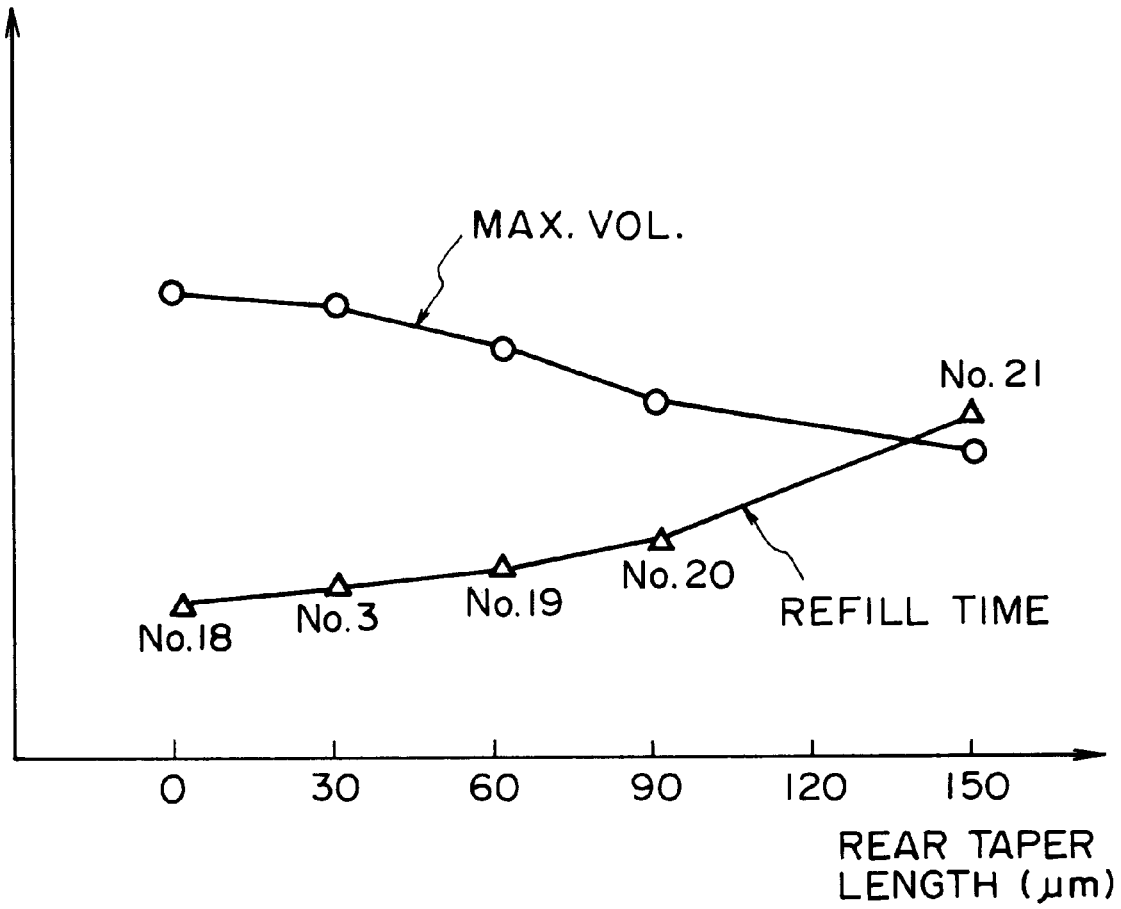
FIG. 20 shows results of tests of a nozzle of the present invention in which the backward cross-sectional area changing portion is changed.

FIG. 20 shows evaluations of the nozzles No. 18–21 in which the rear area changing portion length L2 is changed in the range between 0–150 μm. With the increase of the rear area changing portion length L2, the maximum volume of the bubble decreases. When, however, the rear area changing portion L2 exceeds 90 μm, the refilling time increases, probably because of the increase in the flow resistance by the area changing portion. Accordingly, the optimum range of the rear area changing portion length is 0–90 μm, and as a ratio to the length of the heat generating portion, it is preferably 0–⅗.

As will be understood from the foregoing discussions, from the standpoint of increasing the service life of the heater (heat generating resistor layer) and reducing the shock waves propagated to the ejection outlet, the throat is preferably such that it has as small as possible an angle as seen from the bubble collapse point. When the throat has a substantial length as in FIG. 15, the throat is defined as the most ejection side portion of the throat. In other words, the area of the throat is preferably as small as possible.

However, the flow resistance of the throat increases with the decrease of the area thereof, and therefore, there is a proper range. According to the conducted by the inventors, the cross-sectional area of the opening of the throat is preferably not less than ⅛ and not more than ⅞ of the maximum cross-sectional area of the flow passage in the nozzle.

The position of the throat will be considered. If it is too close to the ejection outlet, the ability of the throat for improving the refilling property and the ink ejection speed and quantity, is reduced, and therefore, the throat position is preferably disposed between the bubble collapse point and a position L/5 (L is heater length) or more upstream of the ejection side edge of the heater. More preferably, it is disposed adjacent the center between the ejection side edge of the heater and the bubble collapse point.

Figure 21:
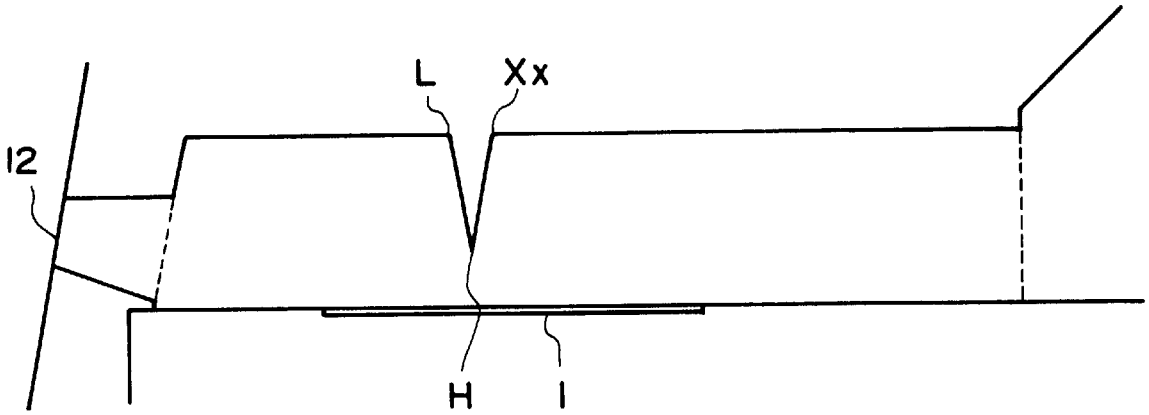
FIG. 21 is a sectional view of a recording head according to a further embodiment of the present invention.
Figure 22:
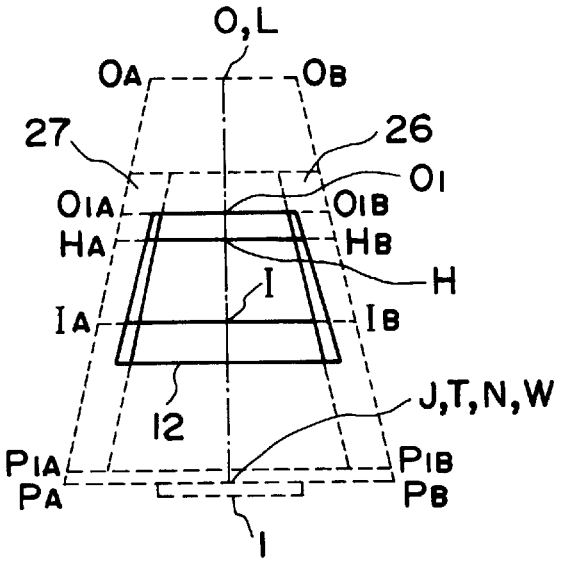
FIG. 22 is a front view of a nozzle according to a further embodiment of the present invention.

In order to further reduce the propagation of the shock waves toward the ejection outlet at the time of the bubble collapse without degrading the refilling property, the front area changing portion may have a shorter length as shown in FIG. 21 in order to reduce the flow resistance. In this case, the surfaces LH, HXX may be curved. In this embodiment, the sectional area is a longitudinal sectional view taken along a plane including the symmetric axis. When the nozzle has such a cross-section that the width of the ink passage decreases from the heat generating resistor containing surface to the surface faced thereto, for example, when the cross-section is symmetric trapezoidal, the area reducing portion formed at the top surface of the ink passage is capable of adjusting the pressure produced by the bubble creation and to adjust the shock wave produced by the bubble collapse, without impeding the flow of the ink along the heat generating resistor. In this embodiment, one throat portion is formed above the heat generating resistor. However, a plurality of such throats may be provided depending on the required adjustments of the flow resistance and the wave propagation at the bubble collapse.

FIG. 9 shows an example in which projections 26 and 27 are provided between L and H and N and J in order to further reduce the shock wave propagated to the ejection outlet. FIG. 9 is a front view of the nozzle as seen from the ejection outlet side. In the foregoing embodiments, the throat was provided by an integral portion of the wall constituting the ink passage, but this is not limiting, and may be in the form of a separate member or members. In the foregoing, the throat constituting portion is formed on the surface facing the ejection heater surface, but it or they may be formed on one or more of the lateral wall surfaces.

Referring back to FIG. 4, the shock wave regulating portion 9 in the form of a throat can be defined as an end of the above-described shock wave correcting portion or as the transient region from the monotonically reducing cross-sectional area portion to the monotonically increasing region toward the ejection outlet of the passage. The cross-sectional area of the opening of the shock wave regulating portion 9 is preferably larger than the cross-sectional area of the opening of the backward liquid regulating portion 10 which will be described hereinafter. Also preferably, it is disposed before the extension of the central axis of the ejecting outlet reaches the heat acting surface. In addition, the cross-sectional configuration of the shock wave regulating portion is preferably symmetrical. From the standpoint of promoting the motion of the liquid toward the ejection outlet side, the cross-sectional configuration in a plane perpendicular to the liquid passage is such that the width increases toward the heat generating resistor. More particularly, the symmetric trapezoidal configuration is preferable as shown in FIG. 4, since then the shock wave buffering effect is promoted.

The rear area changing portion (shock wave reducing portion 5) in the form of a wall partly constituting the throat may be defined as a zone above the heat acting surface (heat acting zone), which is effective to attenuate the shock wave of the bubble collapse or to introduce it in the direction opposite from the ejection outlet. It is preferably monotonically reducing area zone. The preferable conditions for the shock wave reducing portion 5 other than those described hereinbefore is that is comprises a portion facing an ejection side region of the center 1C of the length of the heat generating portion along the liquid passage, more particularly, the portion is not less than 50% (further preferably not less than 70%). It is also preferable that the entirety thereof faces the heat acting portion and the ejecting portion. Preferably it is perpendicularly opposite to the bubble collapse position. Further preferably, the projection thereof to the heat generating surface formed by the normal line to the surface XXH of the reducing portion 5 is in the buffering chamber JT which will be described hereinafter. These conditions are effective not only to regulate the shock wave but also to use the pressure resulting from the creation of the bubble 23 to suppress the expansion thereof toward the liquid chamber. The combination of all of the above conditions is most preferable.

In FIG. 4, an angle β is 30 degrees, and the inclined surface XXH is such that the end point XX of the inclined surface XXH is at an intersection between the surface X and the line perpendicular to the surface Y and passing through the center 1C of the resistor. The cross-sectional area has the configuration preferably as described in conjunction with the shock wave regulating portion 9. In the foregoing, the description has been made as to an example of the liquid passages having the throat for the purpose of improving the refilling nature.

However, in order to further improve the refilling property, it is desirable to suppress the upstream bubble expansion due to inertia after the termination of the energy application to the heat generating resistor, since then the refilling process can be completed with using a smaller quantity of the ink. Then, the next ejection can be started sooner, thus increasing the recording speed.

From the standpoint of suppressing the expansion of the bubble due to inertia without compromising the refilling property when the upstream throat (throat) is used, considerations are paid to conditions in addition to the position of the throat, such as cross-sectional area, the ejection side surface at the throat or the like.

As regards the position of the throat, it is disposed to resist the upstream expansion of the bubble, in other words, it is disposed upstream of the heat generating resistor (bubble creating position). However, if it is too far, the bubble expansion suppressing effect is reduced.

The cross-sectional area of the opening of the throat is preferably small since then the bubble expansion suppression effect is stronger. However, if it is too small, the refilling property is deteriorated.

That is, reducing the opening area of the throat will locally increase the flow resistance to suppress the unnecessary expansion of the bubble. At this time, if the area of the edge of the throat is large, the resistance against the flow becomes large with the result of impedance against the ink supply.

The throat is effective to reduce the required ink supply quantity by suppressing the expansion of the bubble, but the flow resistance is locally increased, and therefore, the ink supply speed becomes lower as compared with the structure without the throat. However, by increasing the opening area toward the ink supply side, the ink supply speed can be made sufficiently high.

Figure 23:
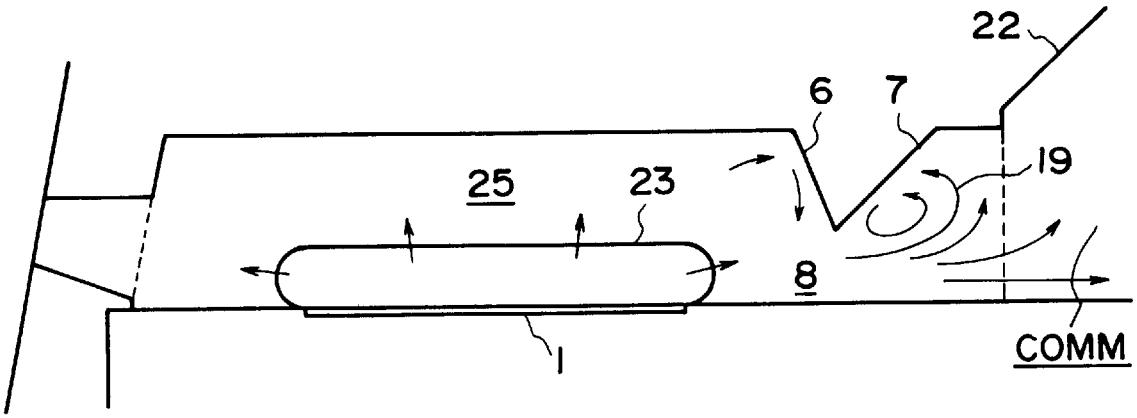
FIG. 23 is a sectional view according to an embodiment of the present invention having an upstream throat.
Figure 24:
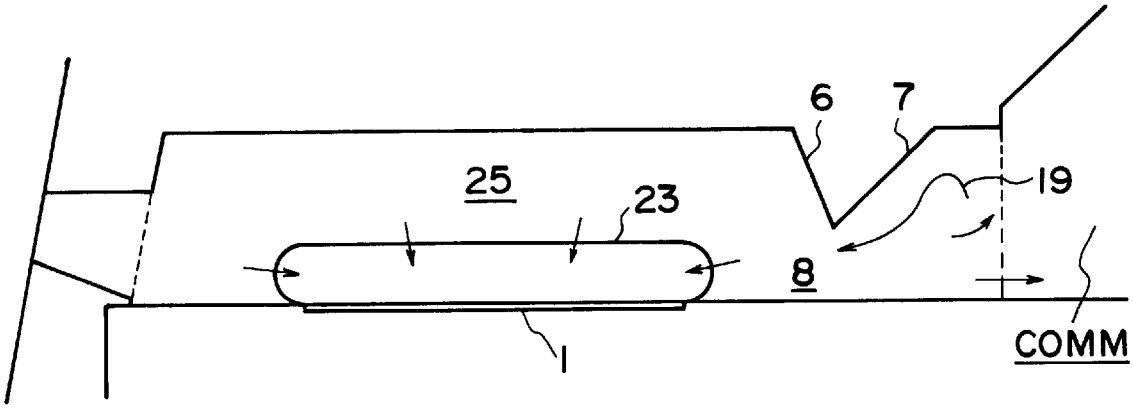
FIG. 24 is a sectional view of a recording head according to a further embodiment of the present invention.

Referring to FIGS. 23, 24 and 4, the description will be made as to the phenomenon and the conditions relating to this. FIGS. 23 and 24 are longitudinal sectional views taken along a plane passing through a central axis of the nozzle. FIG. 23 shows movement of the ink at the time of bubble creation, and FIG. 24 shows motion of the ink during the bubble collapse.

In this embodiment, the throat is disposed upstream of the position corresponding to the heat generating resistor (ejection heater) 1. The configuration thereof is such that the cross-sectional area decreases in a region 7 from a plane 22 of the upstream common liquid chamber through Q-X-XV to the minimum area portion I, and the cross-sectional area again increases in a zone 6 from the minimum portion toward the ejection outlet (I–XW). The region 6 has an angle γ shown in the Figure. The surface is opposed to the ejection heat (bubble creating position). The region 7 has an angle ϵ as shown in the Figure, such that an acute angle is formed between the direction along the region 7 and the surface YU having the ejection heater.

When the heat generating resistor is energized, the bubble is created as shown in FIG. 23, and therefore, the bubble 23 is produced from the ejection heater position. With the expansion of the bubble, the pressure is propagated to the ink in the passage 25, so that a recording droplet is ejected through the outside opening of the ejection outlet 12, and simultaneously, the ink is pushed back upstream in the nozzle. At this time, in the region adjacent the surface 6 in the throat, reversed flow of the ink occurs along the surface XW-I in the direction toward the surface having the ejection heater, as indicated by arrows 20. By this flow of the ink, the upstream expansion of the bubble is suppressed.

The cross-sectional opening area of the throat T-I is smaller than that of the other portions of the liquid passage, and therefore, the pressure is high adjacent the throat (8), by which the upstream expansion of the bubble is suppressed.

On the other hand, during the expansion period of the bubble, the turbulent or eddy flow 19 of the ink is produced in the upstream region 7 and adjacent the region defined by XV-X, so that the flow is produced in the ink convection zone and on the surface 7 in the direction from XV to I. The surface XV-X is effective to stabilize the turbulence 19.

When the energy supply to the ejection heater is stopped, and the bubble starts to collapse, the ink flow toward the liquid chamber produced in the bubble creation is stopped and then the ink supply is started, if the throat is not provided in the nozzle. In this embodiment, however, even if the ink flows toward the common liquid chamber (COMM), the ink is quickly supplied to the ejection heater surface along the surface 7 from the turbulent region 19, and therefore, the refilling time can be reduced. This is because of the provision of the throat means opposed to the ejection heater, and the throat has a surface such as to direct the turbulent flow to the ejection heater.

In this embodiment, the wall 22 of the common chamber (COOM) from the point X has a larger height, and therefore, the ink can be supplied along the top surface from the liquid chamber, irrespective in the backward wave of the ink produced by the bubble creation.

When the throat means is formed upstream of the portion opposite to the ejection heater, the flow (arrow 20) effective to suppress the upstream expansion of the bubble is not produced. In addition, the ink supply to the ejection heater is impeded by the throat means, and therefore, it is difficult to reduce the refilling time.

In addition, the provision of the throat is effective to efficiently propagate the bubble creation pressure for the ejection of the liquid, and therefore, the length of the nozzle upstream from the heat generating resistor can be shortened to permit ejection of the required size droplet. The upstream side beyond the heat generating layer is preferably short, because the ink can be supplied quickly. Therefore, the throat is effective to reduce the length of the nozzle to reduce the ink supply period, thus allowing the high speed recording.

Also, it is effective to suppress the propagation of the shock wave from the bubble collapse point into the common liquid chamber, thus stabilizing ejection of the ink.

Figure 25:
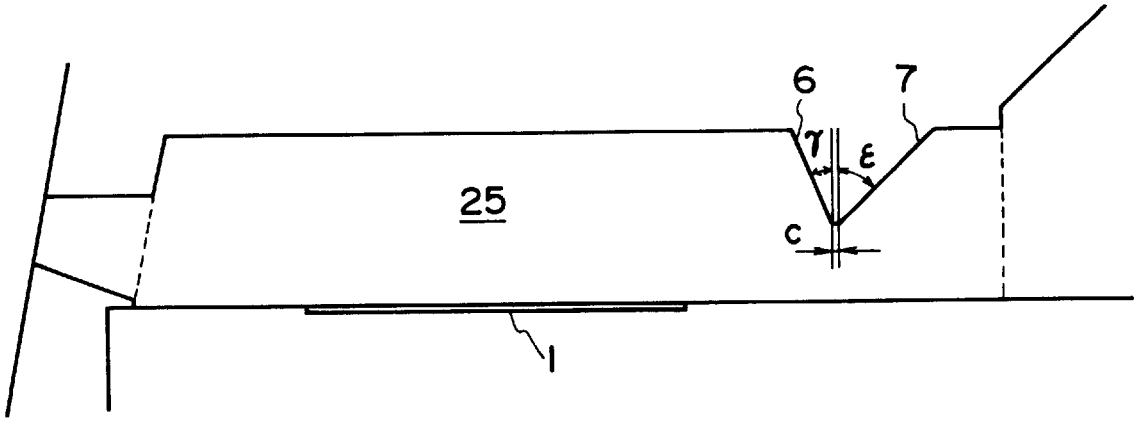
FIG. 25 is a sectional view of a recording head according to a further embodiment of the present invention.
Figure 29:
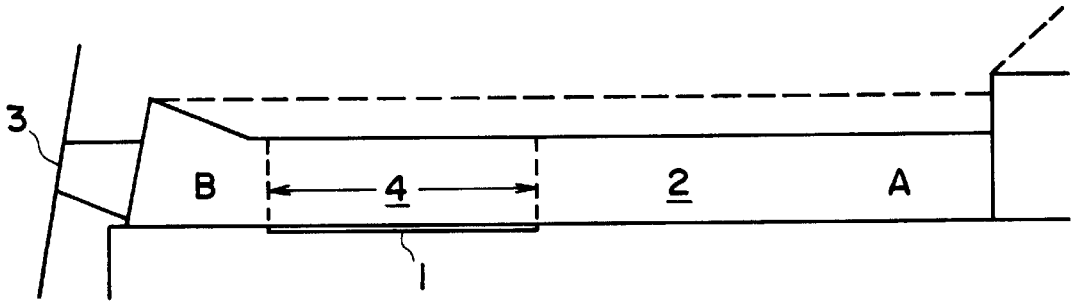
FIG. 29 PRIOR ART
FIG. 29 is a sectional view of conventional (solid line) and comparative examples (solid lines) nozzles.
Figure 30A:
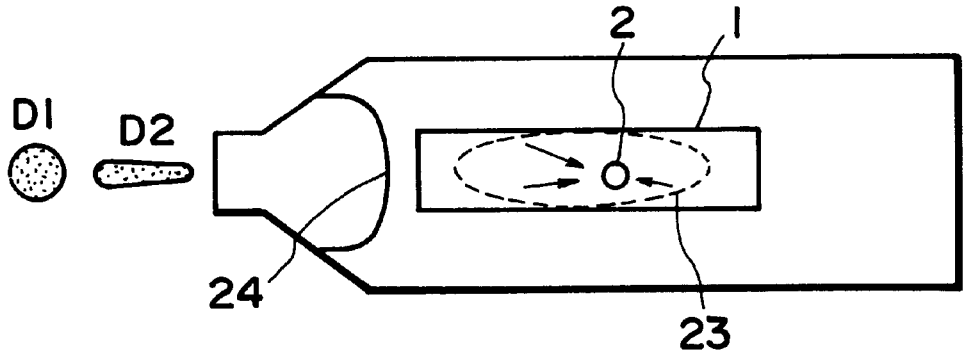
FIG. 30A PRIOR ART
FIGS. 30A, 30B and 30C illustrate liquid ejection in the conventional recording heads.
Figure 30B:
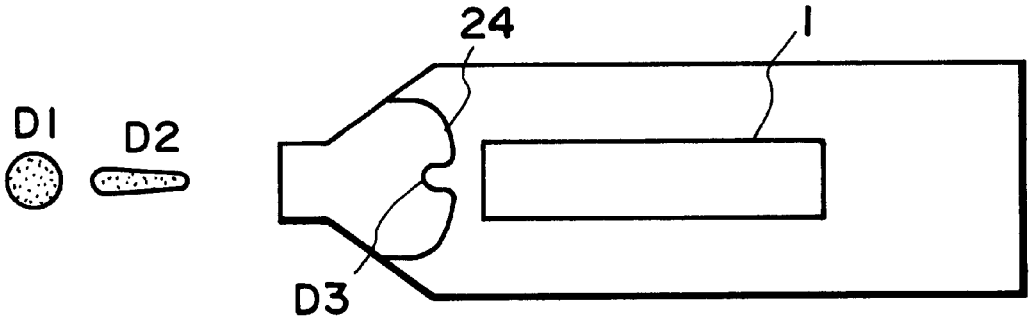
FIG. 30B PRIOR ART
Figure 30C:
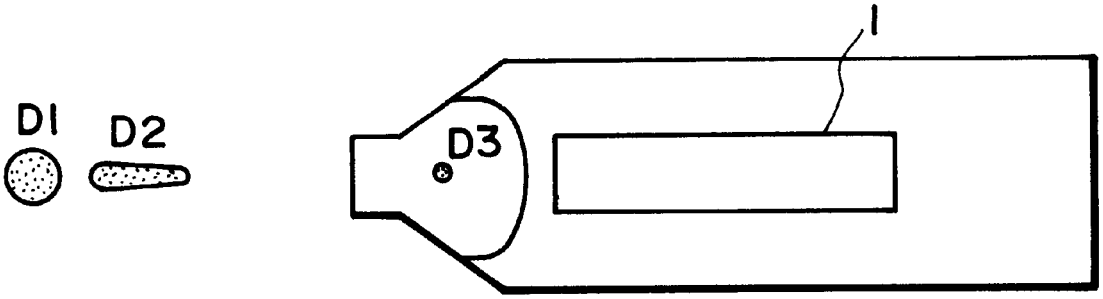
FIG. 30C PRIOR ART

FIG. 25 is a further embodiment of the present invention in which the throat is disposed at a position away from an upstream end of the heat generating element by a distance of ⅓ of the length of the heat generating element measured along the flow of the liquid. The cross-sectional area is ½ of the maximum, and the length of the nozzle is 350 μm, and the angles A and B are 20 and 30 degrees, and C is 1 μm. FIG. 29 (chain lines) shows a comparative example of the nozzle for ejecting the liquid droplet having the same size as in this embodiment, but without the throat. This has the common configuration and dimension except for the throat and the nozzle length. In order to eject the liquid droplet having the same size as in this embodiment, the comparative example nozzle required 500 μm. In the nozzle of this embodiment, approximately 200 μsec is required from the ejection to the completion of the ink supply. In the case of the comparative nozzle, approximately 330 μsec is required. This confirms one of the advantages of the throat, that is, the reduction of the ink supply time. In this embodiment, the expansion of the bubble is suppressed to the downstream by the throat. In the comparative example, however, the bubble expanded more upstream than the position corresponding to the throat of this embodiment. Thus, the bubble inertia expansion preventing effect by the throat has also been confirmed.

Table 2 shown the dimensions of nozzles in the test for confirming the effects of the throat, in which the position and the dimension of the throat is changed. Nozzle No. 1 corresponds to this embodiment. Nozzles Nos. 2–4 have different angles γ in FIG. 25. Nozzles Nos. 5–7 have different angle ϵ. Nozzles Nos. 8 and 9 have different end lengths C (μm). Nozzles Nos. 10–12 have different positions of the throats. The figures in the Table are distances from the upstream end of the ejection heater (heat generating resistor) when the length of the ejection heater along the flow of the ink is made 1. For the nozzles Nos. 1–9, evaluations are indicated by "G" if the bubble expansion does not exceed the throat toward the upstream. For the nozzles 10–12, the evaluation "G" means as a comparison with the case of no throat.

TABLE 2

| No. | γ (deg.) | ϵ (deg.) | C | Throat position | Refilling time (μs) | Bubble suppression |
|---|---|---|---|---|---|---|
| 1 | 20 | 30 | 1 | 1/3 | 200 | G |
| 2 | 45 | 30 | 1 | 1/3 | 210 | G |
| 3 | 60 | 30 | 1 | 1/3 | 230 | G |
| 4 | 75 | 30 | 1 | 1/3 | 250 | N |
| 5 | 20 | 45 | 1 | 1/3 | 200 | G |
| 6 | 20 | 60 | 1 | 1/3 | 210 | G |
| 7 | 20 | 75 | 1 | 1/3 | 240 | G |
| 8 | 20 | 30 | 5 | 1/3 | 240 | G |
| 9 | 20 | 30 | 10 | 1/3 | 290 | G |
| 10 | 20 | 30 | 1 | 1/2 | 200 | G |
| 11 | 20 | 30 | 1 | 1/1 | 200 | G |
| 12 | 20 | 30 | 1 | 3/2 | 200 | N |

As a result of testing, it has been found preferable that the throat is within the range from the rear edge of the heater to the front edge of the heater, and that angle γ does not exceed 75 degrees, and that the angle ϵ is small.

It has been confirmed that is the throat is disposed upstream of the bubble collapse position, the propagation of the shock wave toward the liquid chamber can be suppressed, so that the ejection of the liquid is stabilized.

If the length C of the throat is too long, the resistance against the ink flow is large, and therefore, it is preferably short. However, practically, it is considered in terms of its area. The area of the throat (the area defined by the surfaces XBD and XWE which are parallel to the surface passing through and opposed to the end portion) is preferably small. The preferable range is determined in terms of the cross-sectional area of the flow passage (ink supply in the ejecting detection) in the throat position. More particularly, it is not more than ⅓, further preferably not more than ¼, of the cross-sectional area of IT.

As regards the angle γ, it is concerned with the effect of reflecting the pressure wave to the region (surface) 6 during the bubble creation back to the bubble. In view of this, the angle γ is practically not less than 0 and not more than 45 degrees. Further preferably, it is not less than 5 degrees and not more than 40 degrees. Most preferably, the angle γ is not more than 30 degrees.

From the standpoint of efficiently supplying the ink to the ink collapse position during the ink collapsing, the angle ϵ is preferably not less than 15 degrees and not more than 60 degrees. Further preferably, in view of the immunity against the ambient condition change, it is preferably not less than 38 degrees and not more than 52 degrees. When the γ satisfies $0 \leqq r \leqq 45$ degrees (or $5 \leqq r \leqq 40$ degrees), ϵ:γ=4:1—2:1 is preferable.

When the cross-sectional configuration of the nozzle is such that it has a larger width on the portion having the ejection heater as in the symmetric trapezoid, the pressure during the bubble creation is high at the top portion away from the ejection heater than in the portion close to the heat generating resistor. By the provision of the throat in the high pressure region, the pressure and the shock wave can be efficiently reduced. The bottom surface having the ejection heater particularly requiring the ink supply has a larger width than the top side, and is free from a part constituting the throat, and therefore, the ink can be supplied smoothly. This is also effective to reduce the refilling time.

In FIG. 4, the walls 6 and 7 for constituting the upstream side of the throat are preferably symmetric in a sectional view perpendicular to the liquid passage. It is also preferable that the cross-sectional area changes monotonically by the walls 6 and 7 from the standpoint of smooth supply of the ink.

An extension D of the surface 7 reaches the non-heat generating-resistor portion of the surface YU having the heat generating resistor. Particularly, it is closer to the liquid chamber than the bubble collapse point of the heat generating resistor. Furthermore, the effect is enhanced if it is adjacent the extension C of the shock wave regulating portion, and the liquid chamber side of the extension C. The upstream throat (back wave regulating portion 10) preferably has a height not more than one half the height of the liquid passage. The number thereof is preferably only one between the heat generating resistor and the liquid chamber connecting portion, from the standpoint of reducing the length of the total liquid passage, but this is not limiting in connection with the other structures.

The description has been made with respect to the two throats in the liquid passage. The region $JHX_xX_wIT$ interposed between the throats, contains the bubble collapse point. This region functions as a buffer chamber for the shock wave.

The buffering chamber functions to buffer the propagation of the upward pressure particularly the upward pressure to the liquid common chamber COMM and simultaneously to utilize the buffering effect to the suppression of the bubble expansion toward the upstream. It at least comprises a liquid outlet region which is disposed ejection outlet side from the center of the heat acting portion and in which the buffering surface is directed toward upstream in the heat acting surface side of the buffering chamber, and a liquid inlet region which is disposed upstream side of the center of the heat acting zone and in which the buffering surface is directed to the center of the heat acting portion. The structure of the buffering chamber is defined by the above-described two throats. In this case, the bubble collapse point is between the two throats. The projections of the walls 5 and 6 constituting the throats onto the surface YU having the heat generating resistor are within the buffering chamber. Almost all of the projection of the surface 6 in the surface direction is projected on the YU surface at the ejection outlet side of the throat 9. These are the preferable conditions for the buffering chamber structure.

With these arrangements, the ink is moved toward the rear or toward the ejection heater with the expansion of the bubble. The flow of the ink not related to the ink ejection is enclosed between the throats (H-XX-XY-I), that is, in the buffering chamber. The ink in the buffering chamber does not have a releasing portion during the bubble creation, and therefore, is forced to expand in the direction H-XX with the result of flow along XW-I (arrow 20). The flow is effective to suppress the created bubble, and thus preventing the unnecessary expansion of the bubble, so that the refilling speed is further increased.

In addition, the energy resulting from the bubble creation can be concentrated to the ejection outlet side, and simultaneously, the backward flow of the ink (backward wave) can be reduced, and also, the time required for the refilling can be reduced. In order to provide the advantageous effects described above, the inclined surface XW-I of the rear throat is preferably upstream of the center of the heat acting zone in the direction of the passage (ink passage on the ejection heater: A-B-XB-K). Further preferably, it is upstream of the heat acting zone. In order to produce the ink flow to the ejection heater during the bubble creation by the surface XW-I, the angle of the surface XW-I is practically $0 \leqq \gamma \leqq 90$ degrees, preferably $5 \leqq \gamma \leqq 60$ degrees, further preferably $5 \leqq \gamma \leqq 45$ degrees, yet further preferably $5 \leqq \gamma \leqq 30$ degrees. The angle H-XX preferably satisfies $\gamma \leqq \beta < 90$ degrees. By disposing the rear throat upstream of the bubble collapse point, the propagation of the shock wave produced by the bubble collapse to the common liquid chamber is suppressed. Thus, the propagation of the shock wave to the other nozzle or nozzles through the common liquid chamber (cross-talk) due to the shock wave can be suppressed, and therefore, the ink ejection through the nozzles is stabilized.

By the provision of the throats sandwiching the bubble collapse position, the pressure, particularly the backward wave which is not necessary for the liquid ejection, and the shock wave can be reduced in the buffering chamber.

In addition, during the collapse of the bubble, the flow of the ink to the bubble collapse position occurs along the surface I-XV to produce turbulent flow toward the ejection heater surface, so that the propagation of the shock wave during the bubble collapse to the ejection heater can be reduced, and therefore, the service life of the heater can be increased.

The flow of the ink (HC direction) along the surface LH of the ejection side throat and the flow (ID direction) from the rear throat meet in the buffering chamber, and therefore, the turbulent flow is produced in the buffering chamber, thus weakening the shock at the time of bubble collapse.

The description will be made as to the recording head and a recording apparatus capable of incorporating the above-described embodiments of the invention.

Figure 26:
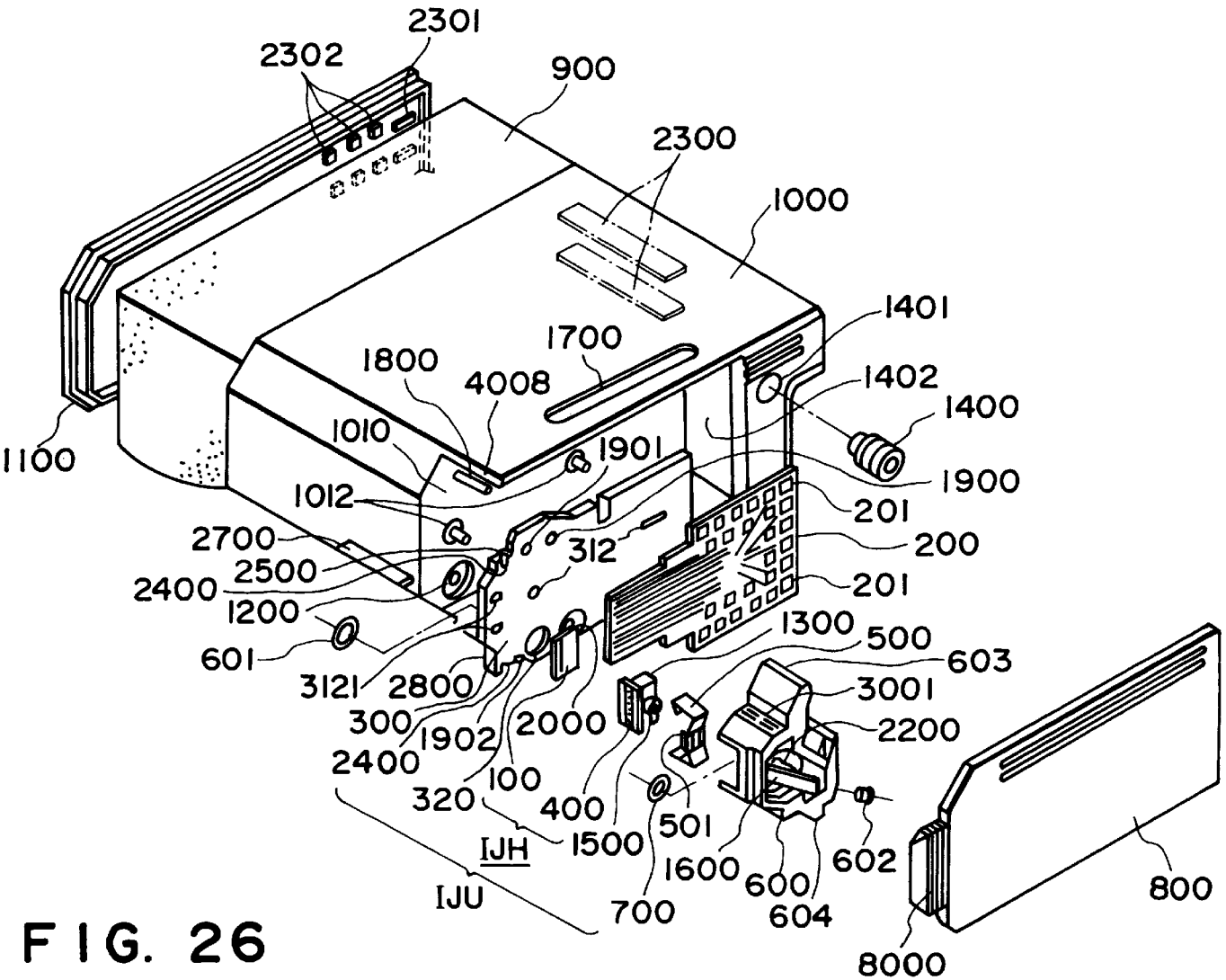
FIG. 26 is an exploded perspective view of an example of an ink jet cartridge according to an embodiment of the present invention.
Figure 27:
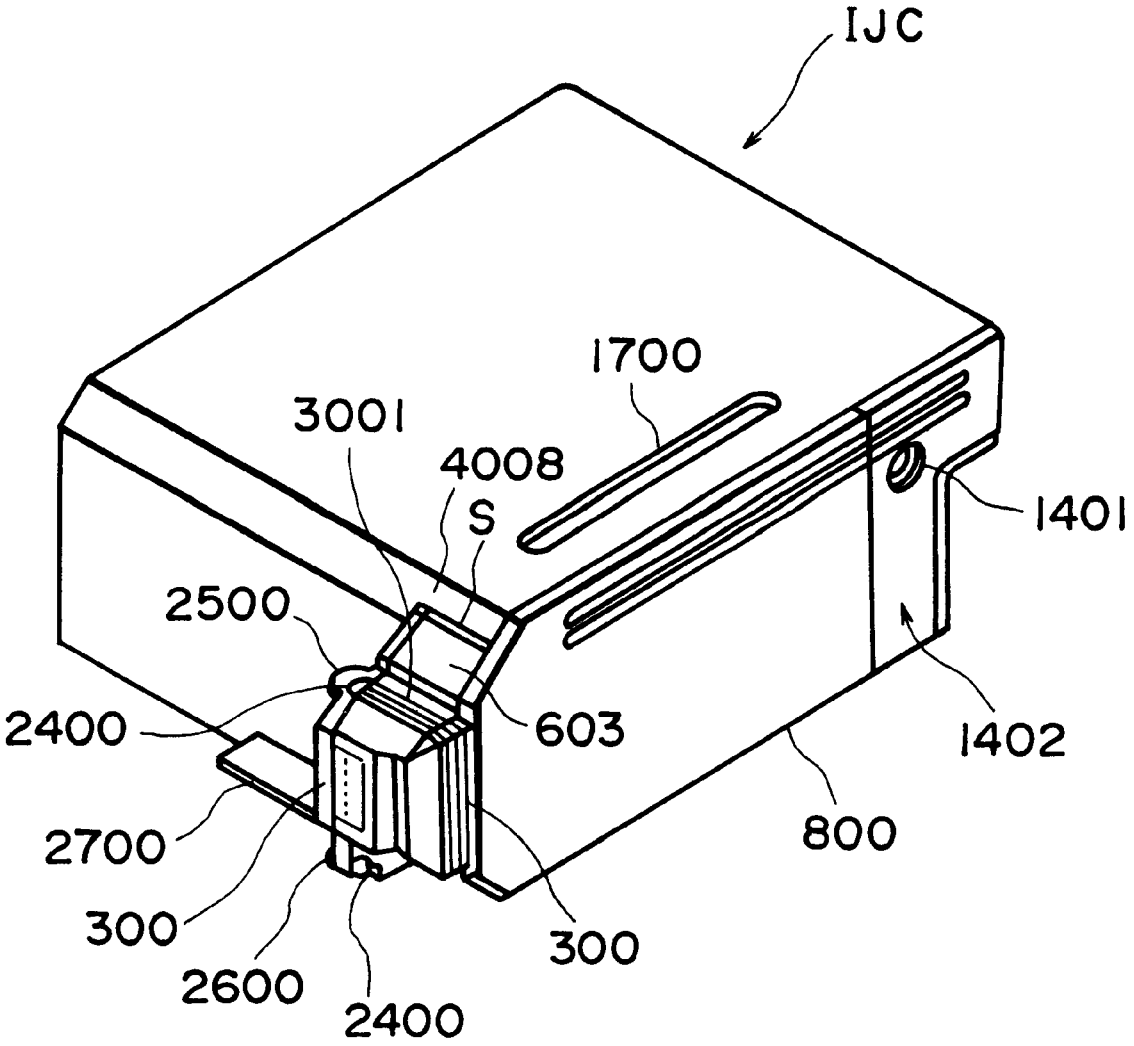
FIG. 27 is a perspective view of FIG. 26.
Figure 28:
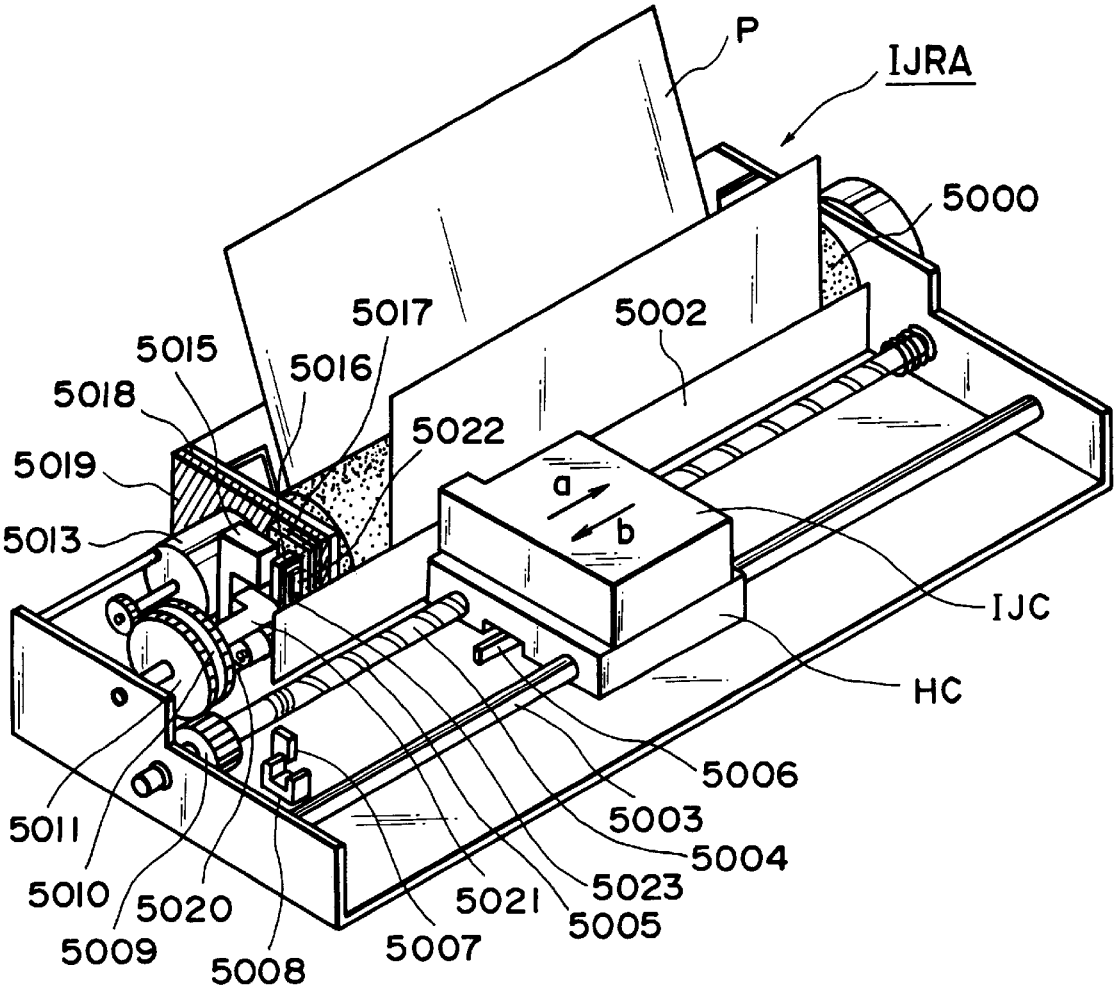
FIG. 28 shows a recording apparatus to which the present invention is applicable.

FIGS. 26, 27 and 28 illustrate an ink jet unit IJU, an ink jet heat IJH, an ink container IT, an ink jet cartridge IJC and a main assembly IJRA of an ink jet recording apparatus, according to an embodiment of the present invention, and relations among them. The structures of the respective elements will be described in the following.

As will be understood from the perspective view of FIG. 27, the ink jet cartridge IJC in this embodiment has a relatively large ink accommodation space, and an end portion of the ink jet unit IJU is slightly projected from the front side surface of the ink container IT. The ink jet cartridge IJC is mountable at a correct position on the carriage HC of the ink jet recording apparatus main assembly IJRA by proper positioning means and with electric contacts, which will be described in detail hereinafter. It is, in this embodiment, a small type head detachably mountable on the carriage AC. The structures disclosed in FIGS. 26 and 27 contain various features, which will first be described generally.

(i) Ink Jet Unit IJU

The ink jet unit IJU is of a bubble jet recording type using electrothermal transducers which generate thermal energy, in response to electric signals, to produce film boiling of the ink.

Referring to FIG. 26, the unit comprises a heater board 100 having electrothermal transducers (ejection heaters) arranged in a line on a silicon substrate and electric lead lines made of aluminum or the like to supply electric power thereto. The electrothermal transducer and the electric leads are formed by a film forming process. A wiring board 200 is associated with the heater board 100 and includes wiring corresponding to the wiring of the heater board 200 (connected by the wire bonding technique, for example) and pads 201 disposed at an end of the wiring to receive electric signals from the main assembly of the recording apparatus.

A top plate 1300 is provided with grooves which define partition walls for separating adjacent ink passages and a common liquid chamber for accommodating the ink to be supplied to the respective ink passages. The top plate 1300 is formed integrally with an ink jet opening 1500 for receiving the ink supplied from the ink container IT and directing the ink to the common chamber, and also with an orifice plate 400 having the plurality of ejection outlets corresponding the ink passages. The material of the integral mold is preferably polysulfone, but may be another molding resin material.

A supporting member 300 is made of metal, for example, and functions to support a backside of the wiring board 200 in a plane, and constitutes a bottom plate of the ink jet unit IJU. A confining spring 500 is in the form of "M" having a central portion urging to the common chamber with a light pressure, and a clamp 501 urges concentratedly with a line pressure to a part of the liquid passage, preferably the part in the neighborhood of the ejection outlets. The confining spring 500 has legs for clamping the heater board 100 and the top plate 1300 by penetrating through the openings 3121 of the supporting plate 300 and engaging the back surface of the supporting plate 307. Thus, the heater board 100 and the top plate 1300 are clamped by the concentrated urging force by the legs and the clamp 501 of the spring 500. The wiring board 200 is mounted on the supporting member 300 by bonding agent or the like. The ink supply member 600 is molded, and therefore, it is produced at low cost with high positional accuracy. In addition, the cantilevered structure of the conduit 1600 assures the press-contact between the conduit 1600 and the ink inlet 1500 even if the ink supply member 600 is mass-produced.

(ii) Ink Container IT

The ink container comprises a main body 1000, an ink absorbing material and a cover member 1100. The ink absorbing material 700 is inserted into the main body 1000 from the side opposite from the unit (IJU) mounting side, and thereafter, the cover member 1100 seals the main body.

The ink absorbing material 900 is thus disposed in the main body 1000.

After the ink jet cartridge IJC is assembled, the ink is supplied from the inside of the cartridge to the chamber in the ink supply member through a supply opening 936, the whole 320 of the supporting member 305 and an inlet formed in the backside of the ink supply member 600. From the chamber of the ink supply member 600, the ink is supplied to the common chamber through the outlet, supply pipe and an ink inlet 1500 formed in the top plate 1300. The connecting portion for the ink communication is sealed by silicone rubber or butyl rubber or the like to assure a hermetic seal.

In this embodiment, the top plate 1300 is made of resin material having resistivity to the ink, such as polysulfone, polyether sulfone, polyphenylene oxide, polypropylene. It is integrally molded in a mold together with an orifice plate portion 400.

As described in the foregoing, the integral part comprises the ink supply member 600, the top plate 1300, the orifice plate 400 and parts integral therewith, and the ink container body 1000. Therefore, the accuracy in the assembling is improved, and is convenient in the mass-production. The number of parts is smaller than in conventional devices so that good performance can be assured.

(iv) General Arrangement of the Apparatus

FIG. 28 is a perspective view of an ink jet recording apparatus IJRA in which the present invention is used. A lead screw 5005 rotates by way of drive transmission gears 5011 and 5009 by the forward and backward rotation of a driving motor 5013. The lead screw 5005 has a helical groove 5004 with which a pin (not shown) of the carriage HC is engaged, by which the carriage HC is reciprocable in directions a and b. A sheet confining plate 5002 confines the sheet on the platen over the carriage movement range. Home position detecting means 5007 and 5008 are in the form of a photocoupler to detect presence of a lever 5006 of the carriage, in response to which the rotational direction of the motor 5013 is switched. A supporting member 5016 supports the front side surface of the recording head to a capping member 5022 for capping the recording head. Sucking means 5015 functions to apply suction to the recording head through the opening 5023 of the cap so as to recover the recording head.

A cleaning blade 5017 is moved toward the front and rear by a moving member 5019. They are supported on the supporting frame 5018 of the main assembly of the apparatus. The blade may be in another form, more particularly, a known cleaning blade. A lever 5021 is effective to start the suction recovery operation and is moved with the movement of a cam 5020 engaging the carriage, and the driving force from the driving motor is controlled by known transmitting means such as clutch or the like.

The capping, cleaning and sucking operations can be performed when the carriage is at the home position by the lead screw 5005, in this embodiment. However, the present invention is usable in another type of system wherein such operations are effected at different timing. The individual structures are advantageous, and in addition, the combination thereof is further preferable.

As described in the foregoing, according to the present invention, the liquid passage structure leads to an ink jet recording head and an ink jet recording apparatus having a high ejection efficiency without satellite printing, so that a high quality printing is possible.

In addition, the number of parts is reduced, so that the structure becomes simplified, and the manufacturing is easy. Particularly, the productivity is remarkably improved in the case of mass-production to provide a high density multi-orifice type head and apparatus.

According to an embodiment of the present invention, a wall portion is deliberately disposed across the liquid passage of the satellite droplet to prevent or impede the satellite droplet from ejecting out of the recording head, so that the satellite droplet printing is prevented or reduced.

The present invention is particularly suitably usable in a ink jet recording head and recording apparatus develped by Canon Kabushiki Kaisha, Japan. This is because high density of the picture elements, and high resolution of the recording, are possible.

The typical structure and the operational principle of this device are preferably as disclosed in U.S. Pat. Nos. 4,723,129 and 4,740,796. The principle are applicable to a so-called on-demand type recording system and a continuous type recording system particularly however, they are suitable for the on-demand type because the principles are such that at least one driving signal is applied to an electrothermal transducer disposed on a liquid (ink) retaining sheet or liquid passage, the driving signal being enough to provide such a quick temperature rise beyond a departure from the nucleate boiling point, by which the thermal energy is provide by the electrothermal transducer to produce film boiling on the heating portion of the recording head, whereby a bubble can be formed in the liquid (ink) corresponding to each of the driving signals. By the development and collapse of the the bubble, the liquid (ink) is ejected through an ejection outlet to produce at least one droplet. The driving signal is preferably in the form of a pulse, because the development and collapse of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion in addition to the structure of the combination of the ejection outlet, liquid passage and the electrothermal transducer as disclosed in the above-mentioned patents. In addition, the present invention is applicable to the structure disclosed in Japanese Laid-Open Patent Application Publication No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because, the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and a plural recording head combined to cover the entire width.

In addition, the present invention is applicable to a serial type recording head wherein the recording head is fixed on the main assembly, to a replaceable chip type recording head which is connected electrically with the main apparatus and can be supplied with the ink by being mounted in the main assembly, or to a cartridge type recording head having an integral ink container.

The provision of the recovery means and the auxiliary means for the preliminary operation are preferable, because they can further stabilize the effect of the present invention. As for such means, there are capping means for the recording head, cleaning means therefor, pressing or sucking means, preliminary heating means by the ejection electrothermal transducer or by a combination of the ejection electrothermal transducer and additional heating element and means for preliminary ejection not for the recording operation, which can stabilize the recording operation.

As regards the kinds of the recording head mountable, it may be a single corresponding to a single color ink, or may be plural corresponding to the plurality of ink materials having different recording color or density. The present invention is effectively applicable to an apparatus having at least one of a monochromatic mode mainly with black and a multi-color with different color ink materials and a full-color mode by the mixture of the colors which may be an integrally formed recording unit or a combination of plural recording heads.

Furthermore, in the foregoing embodiment, the ink has been liquid. It may be, however, an ink material solidified at the room temperature or below and liquefied at the room temperature. Since in the ink jet recording system, the ink is controlled within the temperature not less than 30° C. and not more than 70° C. to stabilize the viscosity of the ink to provide the stabilized ejection, in usual recording apparatus of this type, the ink is such that it is liquid within the temperature range when the recording signal is applied. In addition, the temperature rise due to the thermal energy is positively prevented by consuming it for the state change of the ink from the solid state to the liquid state, or the ink material is solidified when it is left is used to prevent the evaporation of the ink. In either of the cases, the application of the recording signal producing thermal energy, the ink may be liquefied, and the liquefied ink may be ejected. The ink may start to be solidified at the time when it reaches the recording material. The present invention is applicable to such an ink material as is liquefied by the application of the thermal energy. Such an ink material may be retained as a liquid or solid material on through holes or recesses formed in a porous sheet as disclosed in Japanese Laid-Open patent Application No. 56847/1979 and Japanes Laid-Open patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, a copying apparatus combined with an image reader or the like, or a facsimile machine having information sending and receiving functions.

According to the present invention, the propagation of the shock wave during the bubble collapse is controlled so that the image quality is improved without deteriorating the liquid ejecting force or speed.

By the provision of at least one throat in the heat generating resistor portion (ejection heater portion), the size of the bubble is limited, so that the unnecessary backward movement of the ink toward the upstream is suppressed with the advantage of shorter refilling period. As compared with the case without the throat, the quantity of ejection or the ejecting speed are significantly stabilized. Since the shock at the time of bubble collapse is eased, and therefore, the service life of the heater is improved. Additionally, the shock wave produced by the collapse of the bubble is eased, and therefore, the production of the microdroplet attributable to the shock wave is reduced. These advantageous effects are further enhanced by the provision of the upstream throat at a top side.

The bubble collapse point can be determined as follows, for example. Among the walls constituting the passage or path, the wall opposite from the base plate is made of transparent material such as polysulfonic material. The recording head is illuminated by stroboscopic light source which is synchronized with the bubble collapse timing, and the inside of the passage is observed through stereoscopic microscope. In such observation, the pigment or dye componant is removed from the ink since otherwise the observation is difficult.

Such components are usually dissolved in the solvent, and therefore, does not function as the nucleus of the bubble creation or collapse. Accordingly, the removal does not substantially affect the determination of the collapse point. The change of the viscosity of the ink by the removal is very slight, and therefore, does not substantially affect the determination of the bubble collapse point.

It is possible to determine the collapse point with the accuracy of ±5 $\mu$m.

In the foregoing, the collapse point is observed trough a surface parallel to the base. The same method can be used to determine it by observation through a surface perpendicular thereto.

If the recording head has a structure in which the observation is difficult, a proper part of the wall or walls may be removed by may be replaced with a transparent wall. It will be possible to use non-destructive inspection using X-rays or sonic wave.

While the invention has been described with reference to the structures disclosed herein, it is not confined to the details set forth and this application is intended to cover such modifications or changes as may come within the purposes of the improvements or the scope of the following claims.

What is claimed is:

1. A liquid jet head comprising:

a liquid ejecting outlet;

a liquid passage communicating with said ejection outlet and an inlet which are substantially opposed to each other, said liquid passage having an internal surface, a cross-sectional area, and a position which is substantially within a heat acting portion; and a heat generating resistor disposed at said internal surface of said liquid passage for supplying heat to the liquid in the heat acting portion in said liquid to create a bubble in the liquid passage to eject the liquid through said ejection outlet;

wherein the cross-sectional area of said liquid passage increases from the position which is substantially within the heat acting portion and which is closer to said ejection outlet than a point of a collapse of the bubble toward said ejection outlet, and the cross-sectional area starts increasing at the position so that a shock wave formed by the collapse of the bubble is controlled.

2. A liquid head according to claim 1, wherein said liquid ejection outlet has a centerline which crosses with said internal surface.

3. A liquid jet head cartridge comprising:

a recording head having a liquid ejection;

a liquid passage communicating with said ejection outlet and an inlet which are substantially opposed to each other, said liquid passage having an internal surface, a cross-sectional area, and a position which is substantially within a heat acting portion; and a heat generating resistor disposed on said internal surface of said liquid passage for supplying heat to a liquid in the heat acting portion in a volume of a liquid to create a bubble in the liquid passage to eject the liquid through said ejection outlet, wherein the cross-sectional area of said liquid passage increases from the position which is substantially within the heat acting portion and which is closer to said ejection outlet than a point of a collapse of the bubble toward said ejection outlet, and the cross-sectional area starts increasing at the position so that a shock wave formed by the collapse of the bubble is controlled; and a liquid container for containing the liquid, the liquid to be supplied to said recording head.

4. A liquid jet head cartridge according to claim 3, wherein said liquid ejection outlet has a centerline which crosses with said internal surface.

5. A liquid jet apparatus comprising a liquid jet head, said liquid jet head comprising:

a liquid ejecting outlet;

a liquid passage communicating with said ejection outlet and an inlet which are substantially opposed to each other, said liquid passage having an internal surface, a cross-sectional area, and a position which is substantially within a heat acting portion; and a heat generating resistor disposed on said internal surface of said liquid passage for supplying heat to the liquid in the heat acting portion in said liquid to create a bubble in the liquid passage to eject the liquid through said ejection outlet;

wherein the cross-sectional area of said liquid passage increases from the position which is substantially within the heat acting portion and which is closer to said ejection outlet than a point of a collapse of the bubble toward said ejection outlet, and the cross-sectional area starts increasing at the position so that a shock wave formed by the collapse of the bubble is controlled.

6. A liquid jet apparatus according to claim 5, wherein said liquid ejection outlet has a centerline which crosses with said internal surface.

7. A liquid jet head comprising:

a liquid ejecting outlet;

a liquid passage communicating with said ejection outlet and an inlet which are substantially opposed to each other, said liquid passage having an internal surface, a cross-sectional area, and a position which is substantially within a heat acting portion; and a heat generating resistor disposed at said internal surface of said liquid passage for supplying heat to the liquid in the heat acting portion in said liquid to create a bubble in the liquid passage to eject the liquid through said ejection outlet;

wherein a point of a collapse of the bubble is between the internal surface and an extension, to said internal surface, of a plane including a portion of a ceiling where the cross-sectional area of the liquid passage increases from the position which is substantially within the heat acting position toward the ejection outlet at an ejection outlet side of said heat generating resistor, and the cross-sectional area starts increasing at the position so that a shock wave formed by the collapse of the bubble is controlled.

8. A liquid jet head according to claim 7, wherein the increase of the cross-sectional area starts a heat acting portion.

9. A liquid jet head according to claim 7, wherein said liquid ejection outlet has a centerline which crosses with said internal surface.

10. A liquid jet head according to claims 1 or 7, wherein the liquid is ink.

11. A liquid jet head according to claims 1 or 7, wherein a portion of the liquid passage where the cross-sectional area increases has a shape such that a direction of liquid ejection by generating of the bubble and a direction of liquid ejection by a shock wave generated by the collapse of the bubble are substantially codirectional.

12. A liquid jet head cartridge comprising:

a recording head having a liquid ejection outlet;

a liquid passage communicating with said ejection outlet and an inlet which are substantially opposed to each other, said liquid passage having an internal surface, a cross-sectional area, and a position which is substantially within a heat acting portion; and a heat generating resistor disposed on said internal surface of said liquid passage for supplying heat to a liquid in the heat acting portion in a volume of a liquid to create a bubble in the liquid passage to eject the liquid through said ejection outlet; and a liquid container for containing the liquid, the liquid to be supplied to said recording head;

wherein a point of a collapse of the bubble is between the internal surface and an extension, to said internal surface, of a plane including a portion of a ceiling where the cross-sectional area of the liquid passage increases from the position which is substantially within the heat acting position toward the ejection outlet at an ejection outlet side of said heat generating resistor, and the cross-sectional area starts increasing at the position so that a shock wave formed by the collapse of the bubble is controlled.

13. A liquid jet head according to claim 12, wherein the increase of the cross-sectional area starts a heat acting portion.

14. A liquid jet head according to claim 12, wherein said liquid ejection outlet has a centerline which crosses with said internal surface.

15. A liquid jet head cartridge according to claims 3 or 12, wherein the liquid is ink.

16. A liquid jet head cartridge according to claims 3 or 12, wherein a portion of the liquid passage where the cross-sectional area increases has a shape such that a direction of liquid ejection by generation of the bubble and a direction of liquid ejection by a shock wave generated by the collapse of the bubble are substantially codirectional.

17. A liquid jet apparatus comprising a liquid jet head, said liquid jet head comprising:

a liquid ejecting outlet;

a liquid passage communicating with said ejection outlet and an inlet which are substantially opposed to each other, said liquid passage having an internal surface, a cross-sectional area, and a position which is substantially within a heat acting portion; and a heat generating resistor disposed at said internal surface of said liquid passage for supplying heat to the liquid in the heat acting portion in said liquid to create a bubble in the liquid passage to eject the liquid through said ejection outlet:

wherein a point of a collapse of the bubble is between the internal surface and an extension, to said internal surface, of a plane including a portion of a ceiling where the cross-sectional area of the liquid passage increases from the position which is substantially within the heat acting portion toward the ejection outlet at an ejection outlet side of said heat generating resistor, and the cross-sectional area starts increasing at the position so that a shock wave formed by the collapse of the bubble is controlled; and feeding means for feeding a recording material.

18. A liquid jet apparatus according to claim 17, wherein the increase of the cross-sectional area starts a heat acting portion.

19. A liquid jet apparatus according to claim 17, wherein said liquid ejection outlet has a centerline which crosses with said internal surface.

20. A liquid jet apparatus according to claims 6 or 17, wherein the liquid is ink.

21. A liquid jet apparatus according to claims 5 or 17, wherein a portion of the liquid passage where the cross-sectional area increases has a shape such that a direction of liquid ejection by generation of the bubble and a direction of liquid ejection by a shock wave generated by the collapse of the bubble are substantially codirectional.

* * * * *

UNITED STATES PATENT AND TRADEMARK OFFICE

CERTIFICATE OF CORRECTION

PATENT NO. : 6,022,100

DATED : February 8, 2000

INVENTOR(S) : MASANORI TAKENOUCHI ET AL.

It is certified that error appears in the above-identified patent and that said Letters Patent is hereby corrected as shown below:

COLUMN 1:

Line 14, "heat" should read --head--;
Line 20, "ejected," should read --ejected--; and
Line 14, "heat." should read --head.--.

COLUMN 2:

Line 22, "quality." should read --quality,--;
Line 39, "the" should read --the ink--; and
Line 55, "period." should read --period is increased.--.

COLUMN 3:

Line 20, "has" should read --have--; and
Line 48, "having" should read --have--.

COLUMN 4:

Line 17, "object," should read --objects--.

COLUMN 5:

Line 63, "by" should be deleted.

COLUMN 6:

Line 1, "a" should read --an--;
Line 3, "show" should read --of--; and
Line 48, "b," should read --B,--.

UNITED STATES PATENT AND TRADEMARK OFFICE

CERTIFICATE OF CORRECTION

PATENT NO. : 6,022,100

DATED : February 8, 2000

INVENTOR(S) : MASANORI TAKENOUCHI ET AL.

It is certified that error appears in the above-identified patent and that said Letters Patent is hereby corrected as shown below:

COLUMN 7:

Line 25, "to the" should read --to be--;
Line 32, "configuration of" should read --a--; and
Line 57, "HF," should read --HJ,--.

COLUMN 8:

Line 53, "KA and," should read --KA, and--; and
Line 59, "nearest" should read --nearer--.

COLUMN 9:

Line 50, "plane" should read --place--.

COLUMN 10:

Line 58, "sown" should read --shown--.

COLUMN 11:

Line 59, "be." should read --be obtained.--.

COLUMN 12:

Line 56, "bubble," should read --bubble--.

COLUMN 15:

Line 12, "82 m." should read --μm.--;

UNITED STATES PATENT AND TRADEMARK OFFICE

CERTIFICATE OF CORRECTION

PATENT NO. : 6,022,100

DATED : February 8, 2000

INVENTOR(S) : MASANORI TAKENOUCHI ET AL.

It is certified that error appears in the above-identified patent and that said Letters Patent is hereby corrected as shown below:

COLUMN 15: (cont.)

Line 28, "exceed" should read --exceeds--; and
Line 56, "conducted" should read --experiments conducted--.

COLUMN 17:

Line 27, "with" should be deleted.

COLUMN 20:

Line 30, "high" should read --higher--.

COLUMN 22:

Line 46, "the" should read --to the--.

COLUMN 24:

Line 16, "a" should read --an--;
Line 23, "principle" should read --principles are--;
Line 57, "pressure" should read --the pressure--; and
Line 59, "because," should read --because--.

COLUMN 25:

Line 10, "effect" should read --effects--;
Line 19, "single" should read --single head--;
Line 20, "plural" should read --plural heads--;
Line 32, "within" should read --to have a--;

UNITED STATES PATENT AND TRADEMARK OFFICE

CERTIFICATE OF CORRECTION

PATENT NO. : 6,022,100

DATED : February 8, 2000

INVENTOR(S) : MASANORI TAKENOUCHI ET AL.

It is certified that error appears in the above-identified patent and that said Letters Patent is hereby corrected as shown below:

COLUMN 25: (cont.)

Line 52, "one for" should read --one of--;
Line 53, "materials" should read --printing techniques--; and
Line 61, "deteriorating" should read --degrading--.

COLUMN 26:

Line 3, "eased, and therefore," should read --reduced--;
Line 29, "trough" should read --through--;
Line 35, "by" should read --and--; and
Line 37, "wave." should read --waves.--.

COLUMN 30:

Line 5, "6 or 17" should read --5 or 17,--.

Signed and Sealed this

Eighth Day of May, 2001

*Attest:*

Nicholas P. Godici

NICHOLAS P. GODICI

*Attesting Officer*

*Acting Director of the United States Patent and Trademark Office*